US005856818A

United States Patent [19]

Oh et al.

[11] Patent Number: 5,856,818

[45] Date of Patent: Jan. 5, 1999

[54] TIMING CONTROL DEVICE FOR LIQUID CRYSTAL DISPLAY

[75] Inventors: Jeong-Min Oh, Seoul; Hyueog-Sang Shin, Kyungki-do, both of Rep. of Korea

[73] Assignee: Samsung Electronics Co., Ltd., Kyungki-do, Rep. of Korea

[21] Appl. No.: 766,374

[22] Filed: Dec. 12, 1996

[30] Foreign Application Priority Data

| | | | |
|---|---|---|---|
| Dec. 13, 1995 | [KR] | Rep. of Korea | 1995-49310 |
| Apr. 4, 1996 | [KR] | Rep. of Korea | 1996-10203 |
| Aug. 8, 1996 | [KR] | Rep. of Korea | 1996-33052 |

[51] Int. Cl.[6] ..... G09G 3/36

[52] U.S. Cl. ..... 345/99; 345/213

[58] Field of Search ..... 345/98–99, 213

[56] References Cited

U.S. PATENT DOCUMENTS

| | | | |
|---|---|---|---|
| 4,511,926 | 4/1985 | Crossland et al. | 345/99 |
| 5,200,741 | 4/1993 | Usui | 345/99 |
| 5,448,259 | 9/1995 | Hidaka | 345/99 |
| 5,731,798 | 8/1995 | Shin | 345/99 |
| 5,774,106 | 6/1995 | Nita et al. | 345/99 |

*Primary Examiner*—Richard A. Hjerpe
*Assistant Examiner*—Tracy H. Nguyen
*Attorney, Agent, or Firm*—Myers Bigel Sibley & Sajovec

[57] ABSTRACT

A timing control device for liquid crystal display including odd data driver ICs and even data driver ICs, both group of ICs being arrayed serially on one part of the liquid crystal display panel, color signals being converted to appear alternately at the odd data and the even-data according to a number of channels of driver IC, the odd data and the even data being transmitted to the odd data driver ICs and the even data driver ICs respectively, each one of the odd data driver ICs and the even data driver ICs simultaneously operating the liquid crystal display, effecting driver frequency to be reduced, the color signal being similar type to a single bank type, enabling the data driver ICs to be arranged on one face of the liquid crystal display panel, effecting compact design of the data driver ICs.

24 Claims, 29 Drawing Sheets

TIMING CONTROL DEVICE FOR LIQUID CRYSTAL DISPLAY

BACKGROUND OF THE INVENTION (1) Field of the invention

The present invention relates to a timing control device, more particularly to a timing control device for providing a color signal to a data driver integrated circuit having an improved single bank configuration.

(2) Description of the Related Art

Generally, a liquid crystal desplay (LCD) module includes a plurality of gate lines and source lines. An LCD module includes: an LCD panel with switching transistors and pixels which are formed at the cross point of each gate lines and source lines; a gate driver which applies a turn-on voltage to the respective gate lines sequentialy; a data driver (also called 'source driver') which applies a gray voltage to the source lines corresponding to a color signal; a timing controller which outputs a control signal and a color signal for driving the gate driver and the data driver after receiving a vertical synchronizing signal, a horizontal synchronizing signal, and a color signal from a graphic controller outside of the LCD module; a voltage generator which generates gate turn-on and turn-off voltages and a common voltage to be applied to the gate driver; and a gray voltage generator which generates a gray voltage to be applied to the data driver.

In the LCD module as described above, the data driver includes a plurality of source driver ICs and the gate driver includes a plurality of gate driver ICs. The data driver IC is provided with a plurality of shift registers for storing inputed color signals by 1 bit for each source line. For example, if a data driver IC covers fifty source lines of the LCD panel, each of the data driver ICs includes fifty shift registers which are connected serially.

There are conventionally two types of the data driver IC array, that is, a dual bank and a single bank.

In the dual bank, data driver ICs are arrayed on both parts of the LCD panel, upper or lower, such that the ICs of one part cross over the ICs of the other part and the source lines in odd number (or even number) are connected to the upper data driver ICs and the source lines in even number (or odd number) are connected lower data driver ICs.

In the single bank, the data driver ICs are serially arrayed on either upper or lower part of the LCD panel.

FIG. 1 shows an LCD of conventional dual bank.

In FIG. 1, PC-SET 11 IS a graphic controller which generates control signals and data signals, wherein the control signals include a vertical synchronizing signal Vsync, a horizontal synchronizing signal Hsync, a data enabling signal DE, and a main clock signal MCLK, and the data signals include an even numbered data DATA_EVEN and an odd numbered data DATA_ODD.

An interface device 12 controls driver circuits 13, 14 and 15 according to the control signal and the data signal from PC-SET 11. An upper data driver circuit (UP SOURCE IC) 14 of the interface device 12 outputs even numbered data (DATA_EVEN) and the lower data driver circuit (DOWN SOURCE IC) 15 outputs odd numbered data (DATA_ODD). An LCD panel 16 is operated by a gate drive circuit 13 and the upper and lower data driver circuits 14 and 15.

In a dual bank LCD, the upper data driver ICs are connected with each other such that color data may be shifted in serial mode, and the case is same for the lower data driver ICs. For example, in a dual bank data driver with 800 source lines and 8 data driver ICs which covers 100 source lines, two sets of four data driver ICs are arrayed on both parts of LCD panel and connected with each other crosswise. The upper four data driver ICs have a structure wherein an output terminal of the last shift register of a preceding IC is connected with an input terminal of initial shift register of current IC. The case is same for lower four data driver ICs.

In case of a single bank data driver with same source lines, eight data driver ICs are serially arrayed on either upper or lower part of the LCD panel and an output terminal of the last shift register of a preceding IC is connected with the input terminal of initial shift register of current IC.

A timing controller in the dual bank has also different structure and function from the same in the single bank. For example, when a color signal with the single bank data array is inputted in a graphic controller, the timing controller in the dual bank arrays each color signals from the graphic controller, dividing the signals into an odd part and an even part and transmitting respectively to the upper data driver ICs and lower data driver ICs of the data driver. However, in case of a single bank timing controller, the dividing process is not necessary.

In a dual bank data driver, both color signals of even number and odd number from the timing controller are inputted simultaneously to upper data driver ICs and lower data driver ICs.

Therefore, in the dual bank data driver, the upper data driver ICs and lower data driver ICs simultaneously drive every source lines of the LCD panel. On the other hand, in the single bank data driver, either upper or lower data driver ICs transmit signals to every source lines of the LCD panel.

If a sustaining period of a data pulse which is inputted to the source line in the dual bank is equal to a sustaining period in the single bank, a driving period of the source line in the single bank data driver is two times of that in the dual bank data driver. Therefore, in order to adjust driving periods to be equal, the operating frequency of the single bank data driver should be twice as much as that of the dual bank data driver.

Generally, the higher is the operating frequency, the more electromagnetic interference (EMI) occurs. Therefore, the single bank data driver is not so useful as the dual bank data driver in view of the operating frequency.

A graphic system for eliminating the EMI was disclosed in Korean patent application no. 95-49696, wherein a carry signal of lower frequency than the main clock signal has been used in stead of the main clock signal.

However, as the data driver ICs are arrayed on both parts of the LCD panel, the dual bank data driver occupies more area in LCD module than the single bank data driver. The single bank data driver is more useful than the dual bank data driver in that it enables further compact design of the LCD panel. Along with currently widespread use of notebook computer, this compactness of the single bank data driver becomes highlighted. And there is increasing requirement of developing LCD driver with a reduced operating frequency and an improved compactness.

SUMMARY OF THE INVENTION

It is an object of the present invention to provide a timing control device for a liquid crystal display (LCD) which reduces the area occupied by a driving circuit as well as reduces an operating frequency.

The LCD which applies the timing control device according to the present invention comprises a LCD panel and a data driver provided with a plurality of data driver ICs serially arrayed on either upper or lower part of the LCD panel. The timing control device transmits a color signal and a control signal to the data driver.

In the data driver, all the odd numbered data driver ICs and all the even numbered data driver ICs are connected so that the data of color signals may be shifted sequentially.

Each of the data driver ICs include a memory device. The number of the data driverr IC for driving a horizontal line of the LCD panel is determined in accordance with the number of shift register within each data driverr IC. For example, if a horizontal line of the LCD panel includes a thousand data lines and each of the data driver IC includes a hundred memory devices, each data driver IC can drive a hundred data lines. In this state, the timing control device divides a thousand color signal data which are inputted sequentially to odd numbered data and even numbered data to a hundred each. The odd numbered data are added to the even numbered data. Odd numbered data after addition are inputted to the first IC among the five odd numbered data driver ICs. Simultaneously, even numbered data after addition are inputted to the first IC among the five even numbered data driver ICs.

The above-described data array according to the present invention is called an improved single bank array.

As described above, each of the odd numbered data driver ICs and the even numbered data driver ICs is able to transmit data sequentially, resulting in the complete filling of a thousand color signal data into each of the data driver ICs. Therefore, a horizontal line on the LCD panel is operated by the data filled in the data driver ICs.

When a same period is given to drive a horizontal line as the case of the single bank, the even numbered data driver ICs drive the LCD panel simultaneously with the odd numbered data driver ICs and it can be understood that the time for driving a data line according to the present invention is twice as long as that of the single bank method. Therefore, the driving period of a pixel on the LCD panel is increased and the main clock frequency can be reduced by half of the single bank method. Moreover, since the data driver ICs are serially arrayed on either upper or lower part of the LCD panel in a similar manner to the single bank method, the LCD according to the present invention enables a compact design of a data driver.

A timing control device according to the first characteristic of the present invention converts a data signal with a dual bank array to a data signal with an improved single bank array.

To achieve the first characteristic, a timing control device according to the present invention comprises:

a control signal processor for generating a control signal to be transmitted to both of a gate driver and a data driver of an LCD after receiving a vertical and a horizontal synchronizing signal and a main clock signal;

a sequential signal generator for generating a latch control signal and a sequential control signal after receiving a main clock signal and a data enable signal;

a plurality of shift blocks for shifting sequentially odd data and even data of a dual bank color signal in response to the main clock signal and for outputting them;

a plurality of latch blocks for outputting simultaneously n number of odd data and n number of even data from the shift block in response to the latch control signal;

a plurality of first composite blocks for generating an odd component of color signal by logical AND function of n/2 number of odd data and n/2 number of even data from the latch block with the sequential control signals in an alternative mode and then by logical OR function of the result of the logical AND function; and a plurality of second composite blocks for generating an even component of color signal by logical AND function of the remaining n/2 number of odd data and n/2 number of even data from the latch block with the sequential control signals in an alternative mode and then by logical OR function of the result of the logical AND function.

In the timing control device according to the first characteristic of the present invention, the first composite block and the second composite block alternately carry out logical AND functions of the odd data and even data of the dual bank color signal with the sequential control signal. Thereby an improved single bank color signal according to the present invention is obtained after rearranging the data of dual bank color signals.

A timing control device according to the second characteristic of the present invention converts a data signal with a single bank array to a data signal with an improved single bank array.

To achieve the second characteristic, a timing control device according to the present invention comprises:

a control signal processor for generating a control signal to be transmitted to a gate driver and a data driver of an LCD after receiving a vertical and a horizontal synchronizing signals and a main clock signal, and also for generating a latch clock signal and a half frequency clock signal obtained by dividing the main clock signal;

a sequential signal generator for generating a sequential control signal from a data enable signal and the half frequency clock signal;

a plurality of shift blocks for shifting sequentially color signal data according to the main clock signal after receiving a single bank color signal and for outputting them;

a plurality of latch blocks for dividing every n number of color data outputted from the shift blocks and for outputting 2n number of color data in response to the latch control signal;

a first composite block for generating an odd component of a color signal by logical AND function of n data from the latch block with the sequential control signals in a serial mode and then by logical OR function of the result of the logical AND function; and a second composite block for generating an even component of a color signal by logical AND function of the remaining n number of data from the latch block with the sequential control signals in a serial mode and then by logical OR function of the result of the logical AND function.

In the timing control device according to the second characteristic of the present invention, every n number of data of the single bank color signals are separated by the first composite block and the second composite block, the divided data being put to a logical AND function so that an improved single bank color signal is obtained. Specifically, the sequential control signal is generated from the half frequency clock signal and the data duration of the improved single bank color signal is two times of the data duration of the single bank color signal.

A timing control device according to the third characteristic of the present invention converts a single bank color signal to an improved single bank color signal without using a shift block.

To achieve the third characteristic, a timing control device according to the present invention comprises:

a control signal processor for generating a control signal for a gate driver and a data driver of an LCD after receiving a vertical and a horizontal synchronizing signals and a main clock signal, and also for generating a half frequency clock signal obtained by dividing the main clock signal;

a sequential signal generator for generating a latch control signal having an equal high level duration with the 1 clock pulse duration of the main clock signal for every n clock pulse of the main clock signal after receiving a main clock signal, a half frequency clock signal and a data enable signal, and for generating a sequential control signal having an equal high level duration with the 1 clock pulse duration;

a plurality of latch blocks for outputting the single bank color signal data sequentially within the high level duration of the latch control signal after receiving the singla bank color signal and the latch control signal, and for sustaining the output state until the next high level duration of the latch control signal is inputted;

a first composite block for generating an odd component of color signal by logical AND function of color signal data outputted from the latch block during the sustaining period with the sequential control signals sequentially and then by logical OR function of the result of the logical AND function; and a second composite block for generating an even component of color signal by logical AND function of color signal data outputted from the latch block during the sustaining period with the sequential control signals of adjusted sequence and then by logical OR function of the result of the logical AND function.

In the timing control device according to the third characteristic of the present invention, a color signal of extended a data duration in the first and the second composite block is obtained while the output state of the color signal data is sustained. This is achieved by adjusting the sequence of the sequential signal during the logic AND function of the sequential control signal and the latch block output signal in the second composite block. The extention of the data duration is achieved by the sequential control signal which is generated from a half frequency clock signal.

Therefore, the timing control device according the the third characteristic can convert the single bank color signal to the improved color signal according to the present invention without a shift block.

A timing control device according to the fourth characteristic converts a color signal either of single bank or dual bank to a data signal which has a structure of an improved single bank array depending on an external selection of a signal and reduces flipflops and gate devices by reducing signal lines of the control signal.

The timing control device according to the fourth characteristic of the present invention comprises:

a control signal processor for generating a control signal to control the gate driver and the data driver of the LCD after receiving a vertical and a horizontal synchronizing signals and a main clock signal, and also for generating a half frequency clock signal obtained by dividing the frequency of the main clock signal;

a data frequency divider for converting the single bank color signal to a dual bank color signal according to the half frequency clock signal when a color signal from an external selecting signal is a single bank, and for outputting the color signal without a converting step when a color signal from an external selecting signal is a dual bank;

a plurality of latch pulse generators for generating a first sequential control signal and a second sequential control signal from the data enable signal and the half frequency clock signal after receiving the data enable signal and the half frequency clock signal, for generating a latch control signal by a logical OR function of more than two of the first sequential control signals, and for generating an adding control signal by a logical OR function of more than two of the second sequential control signals; and a plurality of data processing cells for generating an odd component and an even component of the color signal after latching an odd data and an even data of the dual bank color signal outputted from the data frequency divider and then carrying out a logical function between the latched data and the adding control signal.

The latch control signal and the adding control signal are predetermined such that color signal data appear as much as the number of channels of the data driver IC in the odd component and the even component alternately. The odd component is inputted to odd numbered data driver ICs and the even component is inputted to even numbered data driver ICs.

Therefore, even when the data driver has a serial array of the data driver ICs similar to the single bank type, the data lines of LCD panel can be driven in a dual mode by the odd data and the even data.

As aforementioned, in the timing control device according to the fourth characteristic of the present invention, the number of signal lines of the latch control signal and the sequential control signal are decreased less than the number of channels. Therefore, the number of flipflops and gate devices for the timing control device are reduced.

BRIEF DESCTIPTION OF THE DRAWING

The preferred embodiment of the present invention will now be described more specifically with reference to the attached drawings as follows.

DETAILED DESCRIPTION OF THE PREFERRED EMBODIMENTS

(1) First Embodiment

A timing control device according to the first embodiment of the present invention is described with reference to FIGS. 2 to 12 in the attachment.

Figure 1:
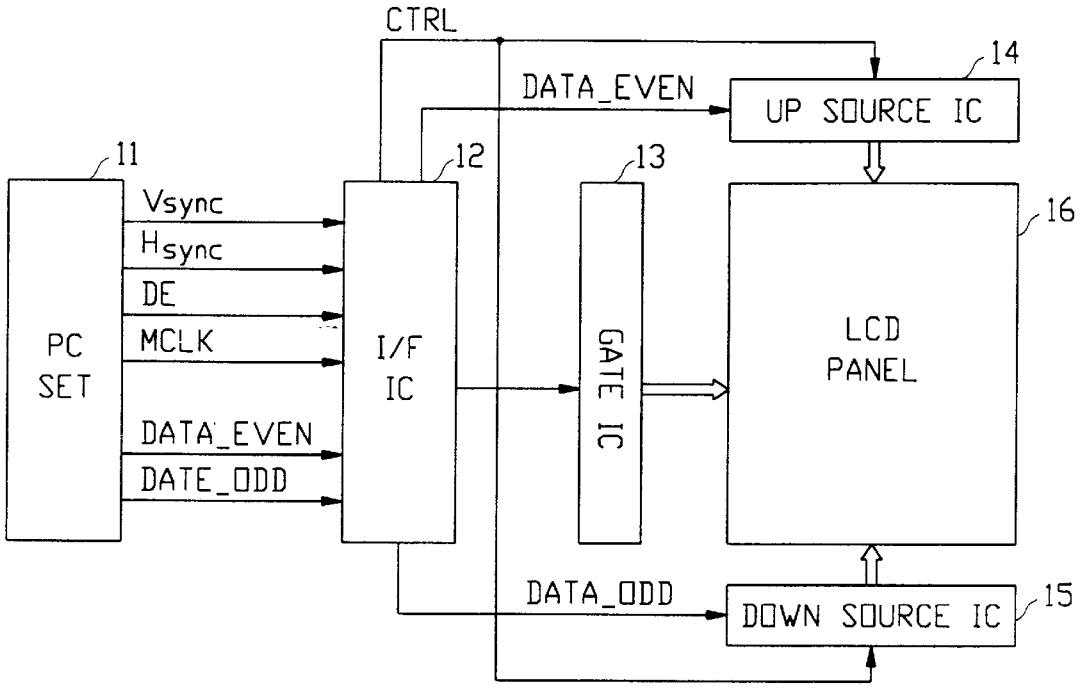
Fig.1 (Prior Art)
FIG. 1 shows a configuration of an LCD which has conventional dual bank array.
Figure 2:
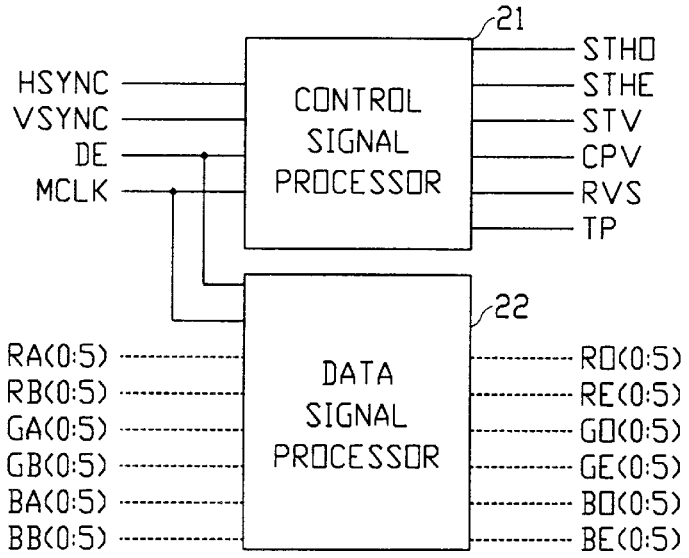
FIG. 2 shows a configuration of a timing control device according to the first embodiment of the present invention.

As shown in FIG. 2, the timing control device according to the first embodiment of the present invention comprises a control signal processor 21 and a data signal processor 22. The control signal processor 21 generates signals required for a gate driver (not shown) and a data driver (not shown) of an LCD after receiving a vertical synchronizing signal VSYNC, a horizontal synchronizing signal HSYNC, a data enable signal DE, and a main clock signal MCLK from an external device such as a graphic controller. The conrol signal processor 21 generates start horizontal signals STHO and STHE, a start vertical signal STV, a gate clock signal CPV, a line reverse signal RVS, and a load signal TP using input signals. The signals generated by the control signal processor 21 are transmitted to the gate driver and the data driver of the LCD. The data signal processor 22 receives a main clock signal MCLK and a color signal which has a dual bank array from an external device such as a graphic controller. As shown in FIG. 8B, a color signal of a dual bank array provides two signals divided as an odd component and an even component. For example, in FIG. 8B, signals RA(0:5) and RB(0:5) are provided for a red signal R, where (0:5) represents RA signal of 6 bits for displaying a multiple gray level.

The data signal processor 22 generates a color signal [RO(0:5), RE(0:5), GO(0:5), GE(0:5), BO(0:5), BE(0:5)] which has a structure of an improved single bank array (hereinafter called 'improved single bank color signal') according to the present invention. The improved single bank color signal includes an odd component and an even component for a color.

Figure 11:
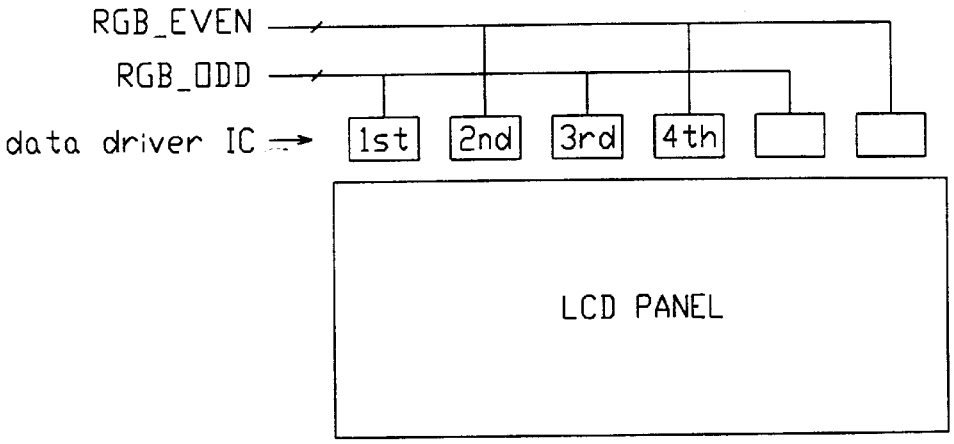
FIG. 11 shows a configuration of an LCD to illustrate color signals of an improved single bank array being inputted to data driver circuit.

In FIG. 11, the odd component RGB_ODD of the improved single bank color signal is inputted to an odd numbered data driver IC, and the even component RGB_EVEN is inputted to an even unmbered data driver IC. As shown in FIG. 11, the data driver IC can be arrayed on either part of an LCD panel when the improved single bank color signal is used in the LCD. Accordingly, a compact design of the LCD is possible.

Figure 12:
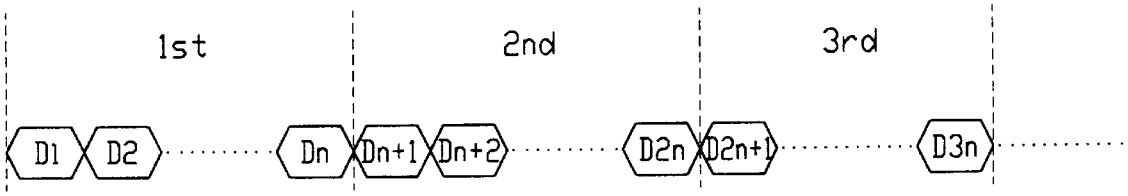
FIG. 12 shows an array of color signals of an improved single bank array.

FIG. 12 shows an array of data which are inputted to each data driver IC. Each of n number of data is sequentially inputted to the data driver IC, where n is a channel number of the data driver IC. In general, color data is inputted to the data driver IC serially and in sequential mode. Since the improved single bank color signal according to the present invention should be divided to an odd component and an even component, it requires a special data array which is different from a conventional single bank or a dual bank.

For example, an odd component RGB_ODD of the improved single bank color signal is formed by an integration of odd numbered data among n data. In FIG. 12, an odd component RGB_ODD is arrayed as D1–Dn, D2n+1–D3n, D4n+1–D5n, . . . , and an even component RGB_EVEN is arrayed as Dn+1–D2n, D3n+1–D4n, D5n+1–D6n, . . . .

It will be described in the following how an array of the improved single bank color signals are fomed from dual bank color signals.

Figure 3:
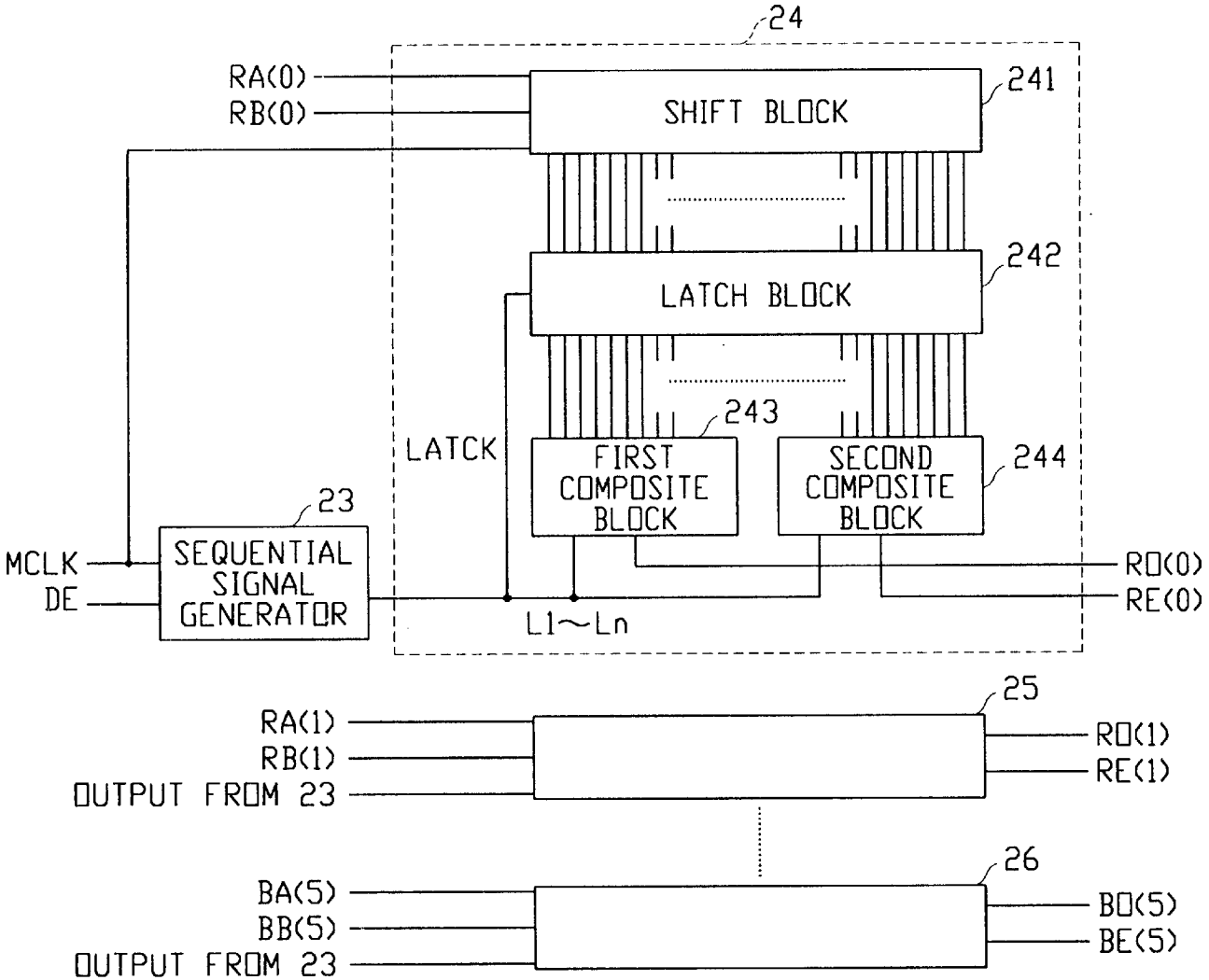
FIG. 3 shows a configuration of the data signal processor in FIG. 2.

FIG. 3 shows the data signal processor of FIG. 2 in further detail.

As shown in FIG. 3, the data signal processor 22 comprises; a sequential signal generator 23 for generating sequential control signals L1–Ln after receiving a main clock signal MCLK and a data enable signal DE, and a plurality of data processing cell 24–26. Each data processing cell generates 1 bit odd component and 1 bit even component of the improved single bank color signal after receiving odd data of 1 bit line and even data of 1 bit line from the dual bank color signal, a sequential control signal from a sequential signal generator 23 and a main clock signal MCLK.

As aforementioned, in the first embodiment of the present invention, 6 bits are alloted to each color of the dual bank color signal, and therefore, 18 data processing cells are requird to process three colors, red R, green G and blue B. In FIG. 3, only one cell 24 among eighteen data processing cells is shown in detail and the remaining cells have an internal configuration equal to the data processing cell illustrated above. The data processing cell 24 generates an odd component RO(0) and an even component RE(0) of the improved single bank color signal after receiving RA(0) and RB(0) among the dual bank color signals.

More specifically, the data processing cell 24 includes a shift block 241, a latch block 242, a first composite block 243 and a second composite block 244. The shift block 241 sequentially shifts and outputs the dual bank color signals RA(0) and RB(0) after receiving RA(0) and RB(0) of 1 bit line and the main clock signal MCLK. The latch block 242 outputs color signals from the shift block 241 in a unit of n color signals according to a latch clock signal LATCK.

In the preferred embodiment of the present invention, one of the sequential control signals is used for the latch clock signal LATCK, but it does not limit the scope of the present invention. The first composite block 243 and the second composite block 244 generate an odd component RO(0) and an even component RE(0) of the improved single bank color signal respectively after receving a signal from the latch block 242 and a sequential control signal from the sequential signal generator 23.

Figure 4:
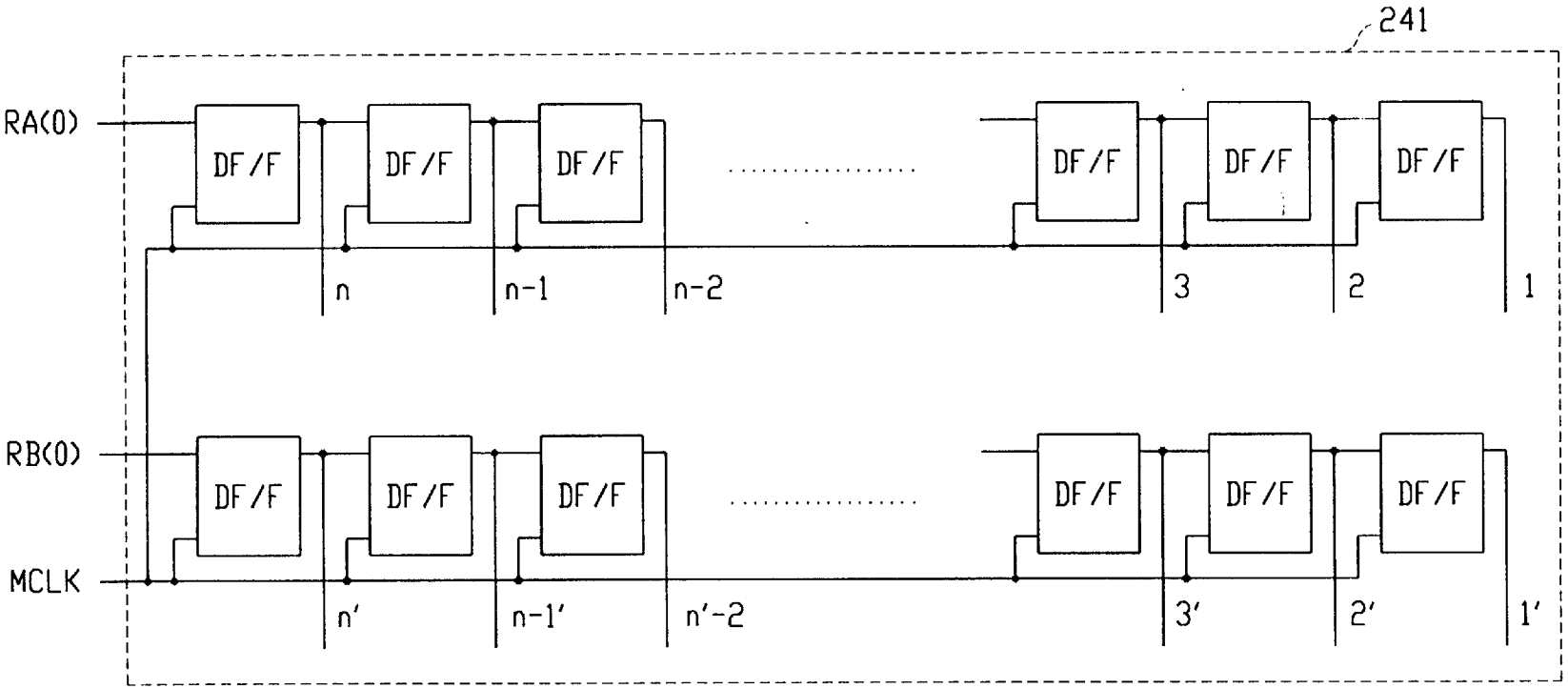
FIG. 4 shows a configuration of the shift block in FIG. 3.

FIG. 4 shows the shift block 241 in detail.

The shift block 241 comprises 2n number of D-flipflops. n number of D-flipflops are serially connected and the remaining n number of D-flipflops are also serially connected each other. The main clock signal MCLK is commonly inputted to each clock terminal of 2n number of D-flipflops. RA(0) is inputted to a data terminal of the first flipflop among n number of D-flipflops and RB(0) is inputted to a data terminal of the first flipflop among the rest n number of D-flipflops. The output terminals of 2n number of D-flipflops are connected to the latch block 242. Each D-flipflop transmits a signal of the data terminal to the output terminal in response to the clock pulse of the main clock signal MCLK. Therefore, the data of the dual bank color signal RA(0) is shifted sequentially and transmitted to the latch block 242 and the data of RB(0) is sequentially shifted and transmitted to the latch block 242 by the other n number of flipflops. The shift block 241 continues to carry out the above-described operation in response to the main clock signal MCLK.

Figure 8A:
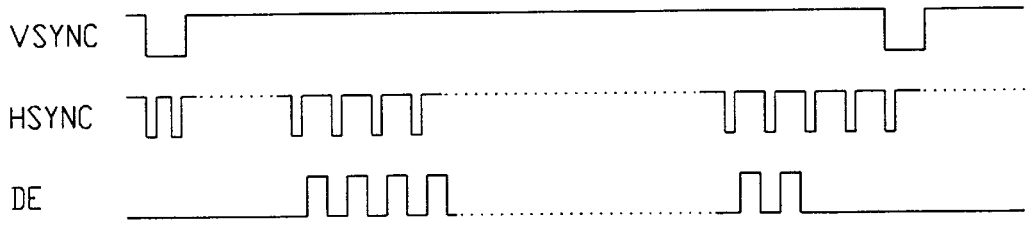
FIG. 8A shows waveforms of a vertical synchronizing signal, a horizontal synchronizing signal and a data enable signal to illustrate timing relations between them.
Figure 8B:
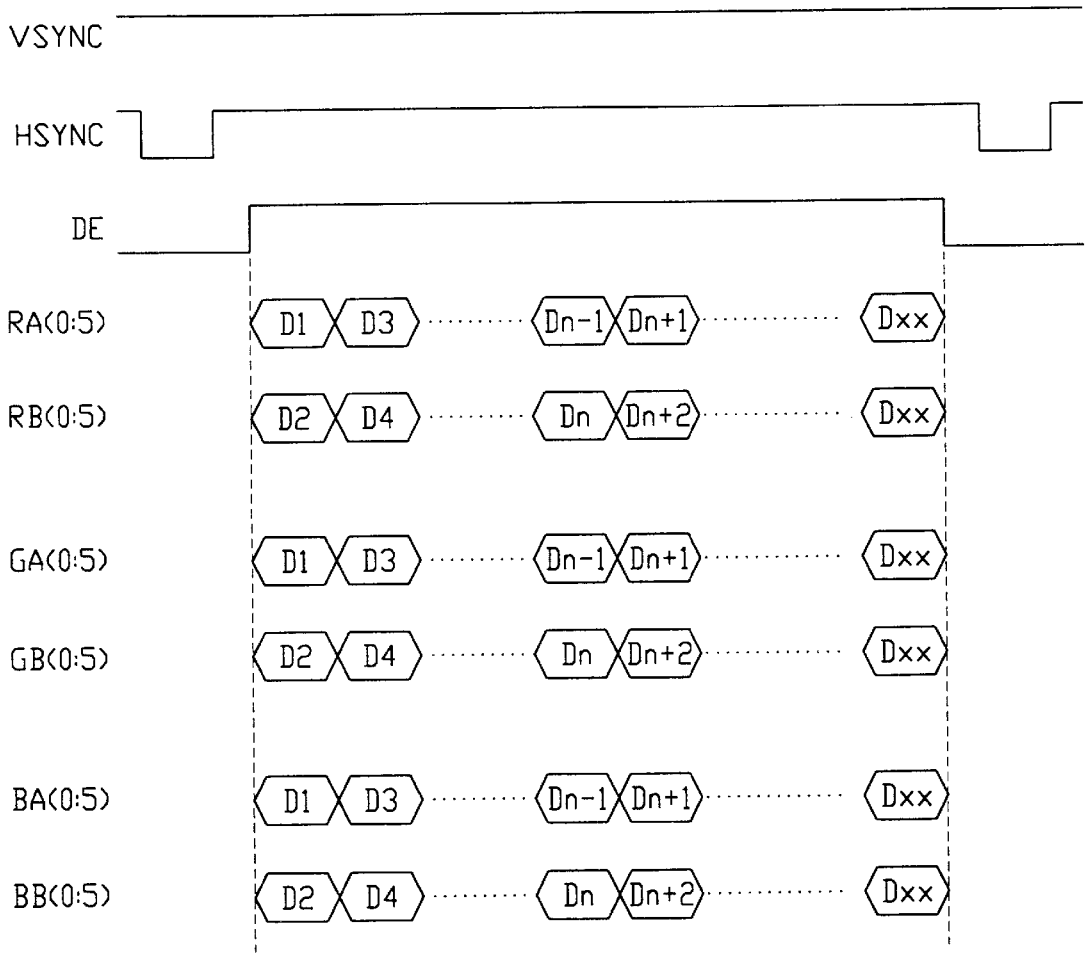
FIG. 8B shows waveforms to illustrate relations between the signals in FIG. 8A and color signals having dual bank arrays.

FIG. 8A illustrates a timing relation between a vertical synchronizing signal VSYNC, a horizontal synchronizing signal HSYNC and a data enable signal DE. A plurality of horizontal synchronizing signals HSYNCs exist during one pulse of the vertical synchronizing signal VSYNC. The data enable signal DE has a frequency equal to the horizontal synchronizing signal HSYNC and has a pulse duration shorter than the horizontal synchronizing signal. It is within a high pulse duration of the data enable signal DE that a data is displayed onto the LCD panel by the data driver ICs.

FIG. 8B illustrates a timing relation between the signals shown in FIG. 8A and the dual bank color signals; RA(0:5), RB(0:5), GA(0:5), GB(0:5), BA(0:5), and BB(0:5).

The shift block 241 shifts sequentially shifts the data of RA(0) and RB(0) shown in FIG. 8B.

Figure 5:
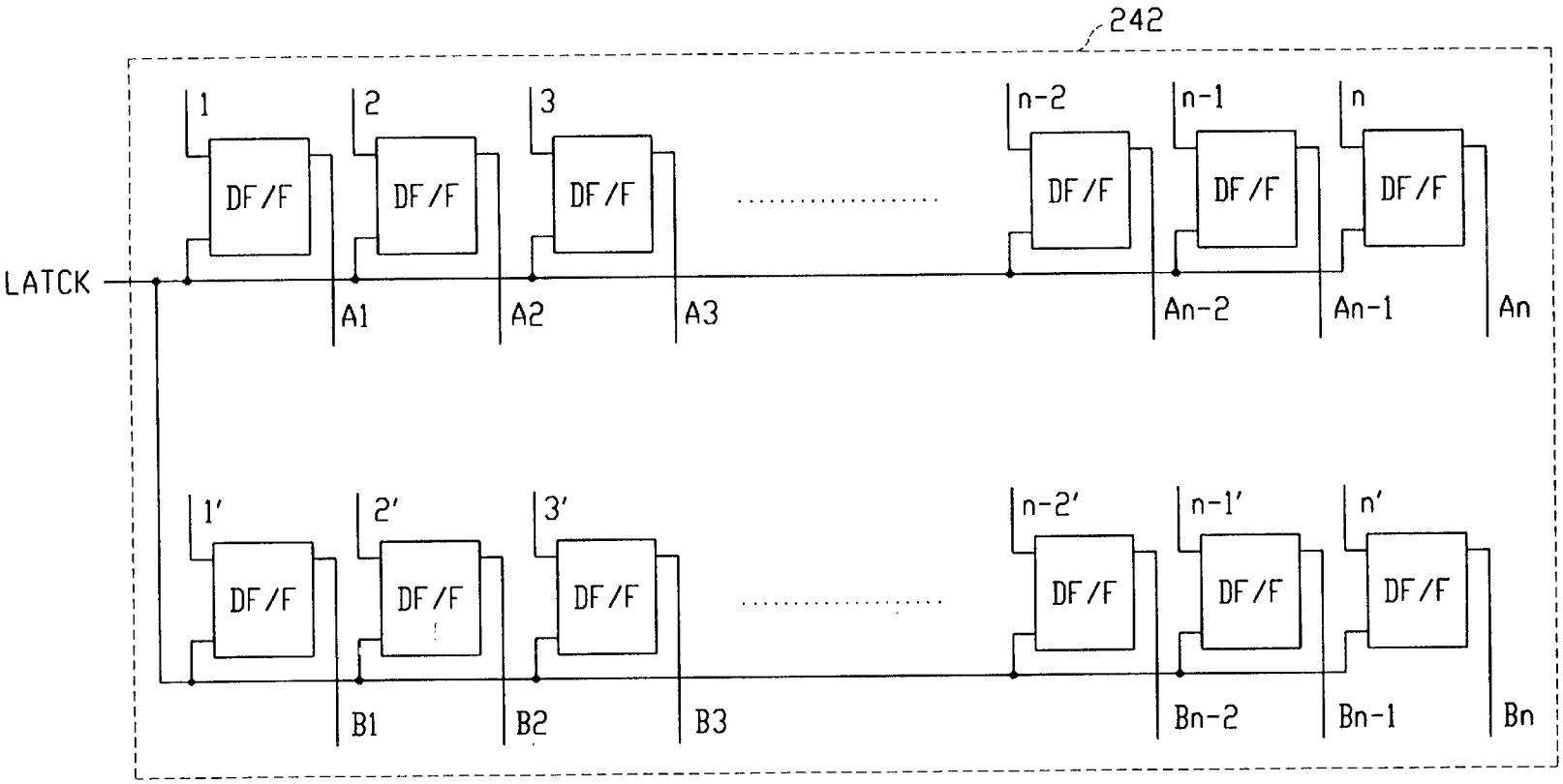
FIG. 5 shows a configuration of the latch block in FIG. 3.
Figure 6:
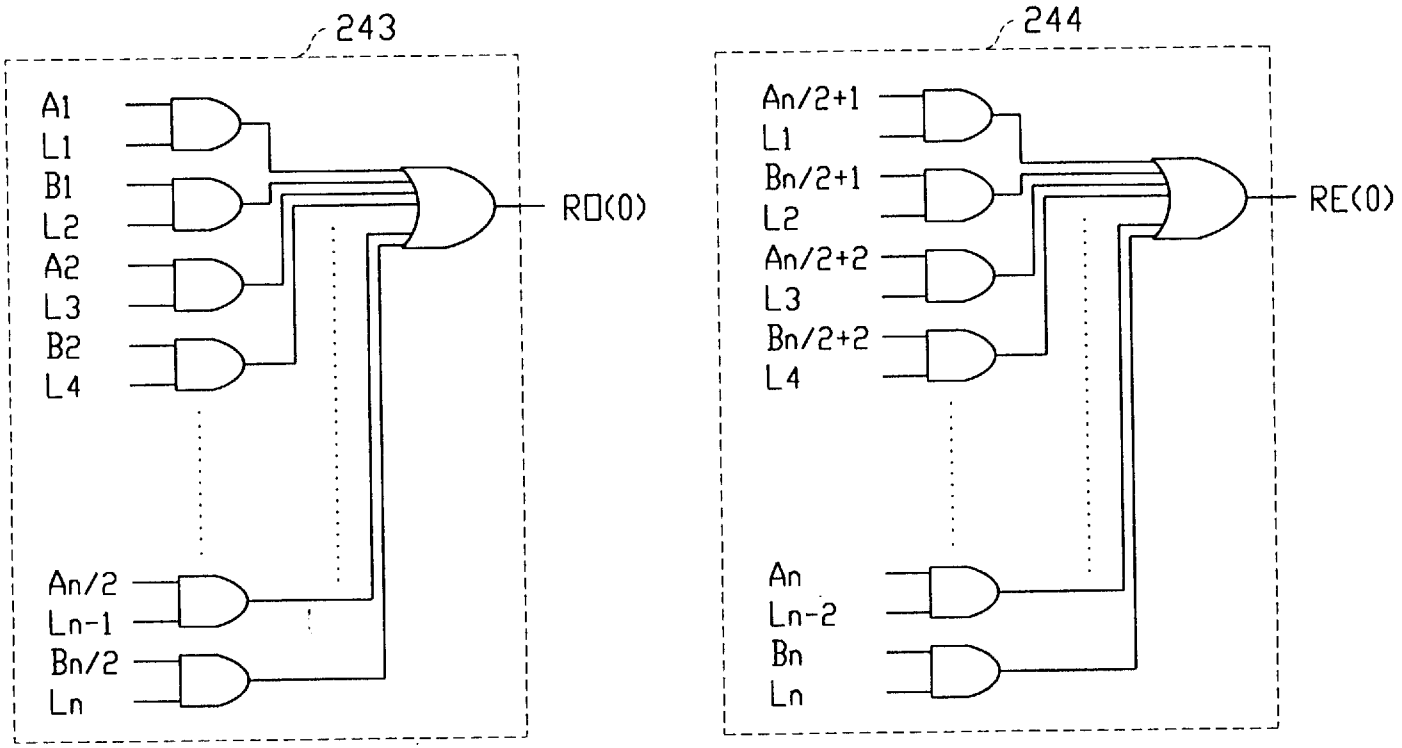
FIG. 6 shows a configuration of the first and the second composite blocks in FIG. 3.

FIG. 5 shows the latch block 242 in detail.

The latch block 242 comprises 2n number of D-flipflops, wherein n number of D-flipflops latch n color signals RA(0) from the shift block 241 and the remaining n number of D-flipflops latch n color signals RB(0). A latch clock signal LATCK is commonly inputted to the 2n number of D-flipflops. The input terminals of the 2n number of D-flipflops in FIG. 5 are connected to the output terminals of the 2n number of D-flipflops in FIG. 4 in serial mode. n number of D-flipflops have n output terminals A1–An and the other n number of D-flipflops have n output terminals B1–Bn. Each of the D-flipflops of the latch block 242 transmits data of the input terminal to corresponding output terminal simultaneously in response to the latch clock signal LATCK.

Figure 7:
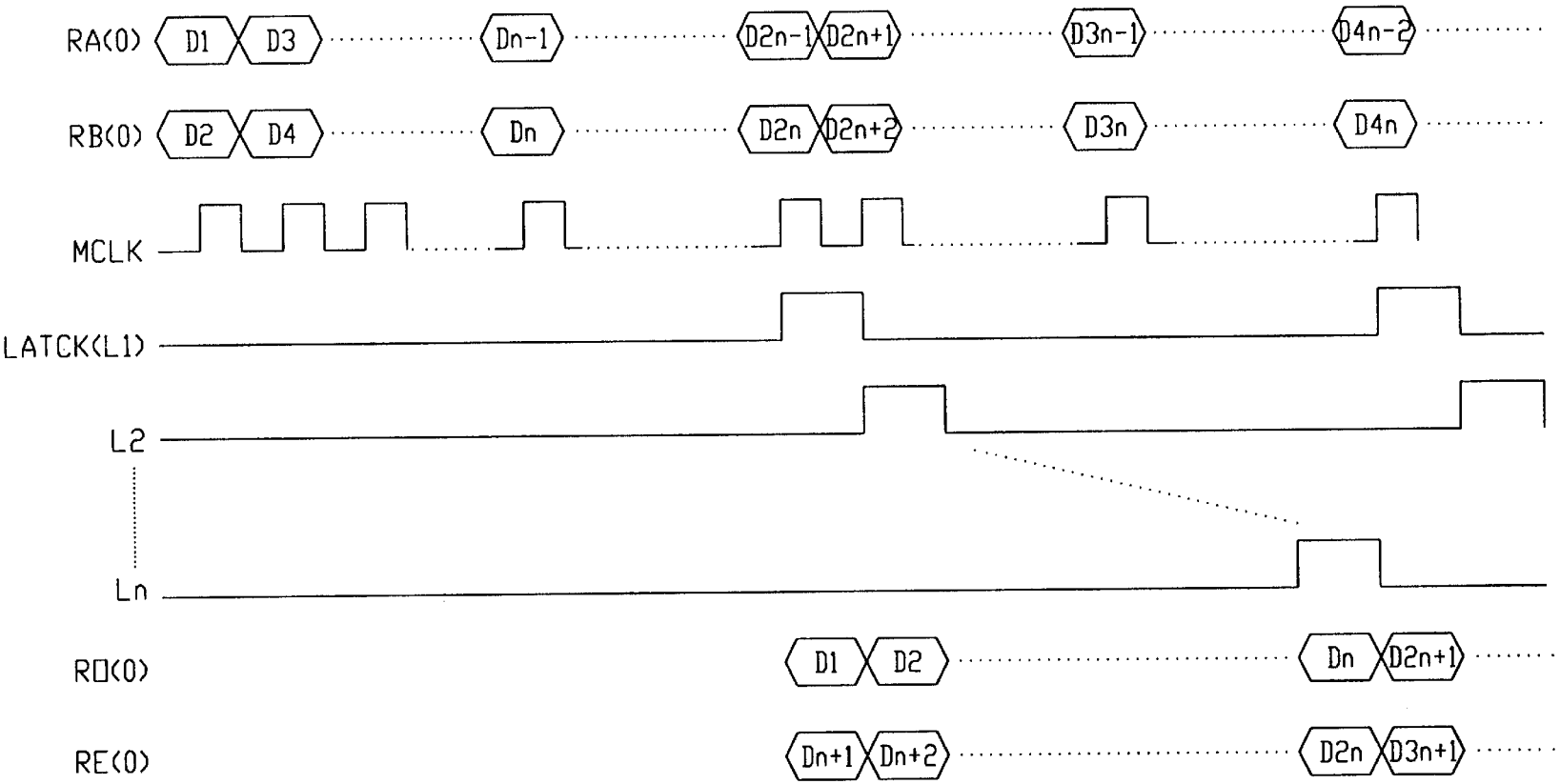
FIG. 7 shows waveforms of the signals from respective components of a timing control device for LCD according to the first embodiment of the present invention.
Figure 9:
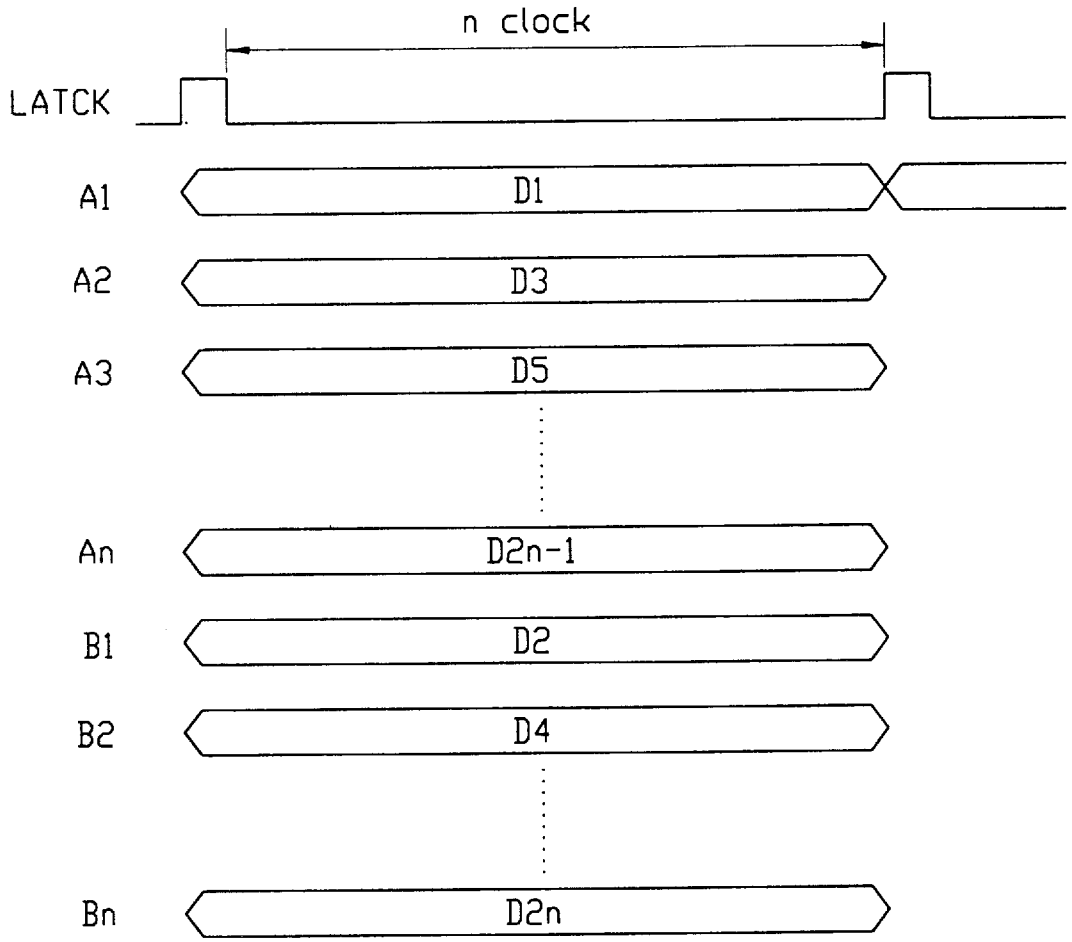
FIG. 9 shows waveforms of signals from the latch block in FIG. 5.

As shown in FIG. 7, in the first embodiment of the present invention, a first sequential control signal L1 is used for the latch clock signal LATCK. By means of the first clock pulse of the sequential control signal L1, n number of data D1–D2n−1 of RA(0) signal are sustained in the output terminal A1–An of the n number of D-flipflops and data D2–D2n of RB(0) signal are sustained in the output terminal B1–Bn. The latch clock signal LATCK has a clock pulse in every n clocks of the main clock signal. The waveform of the latch clock signal LATCK is shown in FIG. 9. A high level duration of the latch clock signal LATCK is equal to a pulse duration of the main clock signal MCLK as shown in FIG. 7.

As shown in FIG. 9, in the output terminals A1–An of the latch block 242, n odd data of the dual bank color signal RA(0) are sustained and similarly n number of even data of the dual bank color signal RB(0) are sustained in the output terminal B1–Bn.

The output signal of the latch block 242 is transmitted to a first composite block 243 and a second composite block 244. The first and the second composite block 243 and 244 are shown in detail in FIG. 6.

Each of the composite blocks 243 and 244 comprises n number of logical AND device and a logical OR device. Each of the logical AND gates of the first composite block 243 has two input terminals. One of the n number of sequential control signals L1–Ln is inputted sequentially to an input terminal of the AND gate and one of the output terminals A1–An/2 and one of the output terminals B1–Bn/2 of the latch block 242 are inputted alternately to the other input terminal of the AND gate.

The sequential control signal L1 and a signal from the output terminal A1 of the latch block 242 are inputted to a first AND gate of the first composite block 243. The sequential control signal L2 and a signal from the output terminal B1 of the latch block 242 are inputted to a second AND gate. The sequential control signal L3 and a signal from A2 are inputted to a third AND gate. In such a way, a sequential control signal Ln−1 and a signal from the output terminal An/2 are inputted to (n−1)th AND gate, and a sequential control signal Ln and a signal from the output terminal Bn/2 are inputted to nth AND gate.

A sequential control signal L1 and a signal from the output terminal An/2+1 of the latch block 242 are inputted to a first AND gate of the second composite block 244. A sequential control signal L2 and a signal from the output terminal Bn/2+1 are inputted to a second AND gate. A sequential control signal Ln−1 and a signal from the output terminal An are inputted to (n−1)th AND gate and a sequential control signal Ln and a signal from the output terminal Bn are inputted to nth AND gate.

The OR gate of each of the composite blocks 243 and 244 generates an odd component RO(0) and an even component RE(0) of the improved single bank color signal after a logical OR function of the output signals of the n number of AND gates. The purpose of the logical AND function of the output signals of the latch block 242 with the sequential control signals L1–Ln in an alternate mode is to convert the data array of the dual bank color signals. Thus, the odd data and the even data of the dual bank color signal are intermixed and sequentially arrayed, dividing an odd component RO(0) and an even component RE(0) of the first composite block in a unit of n color signals.

As shown in FIG. 7 and FIG. 9, the output signals of the latch block 242 are newly arrayed by n sequential control signals L1–Ln which have sequential high level pulse duration. Thereby an odd component RO(0) and an even component RE(0) of the improved single bank color signals can be obtained.

In FIG. 9, data of the odd component RO(0) are alternately arrayed such as D1–Dn, D2n+1–D3n, . . . and data of the even component RE(0) are also alternately arrayed such as Dn+1–D2n, D3n+1–D4n.

Figure 10:
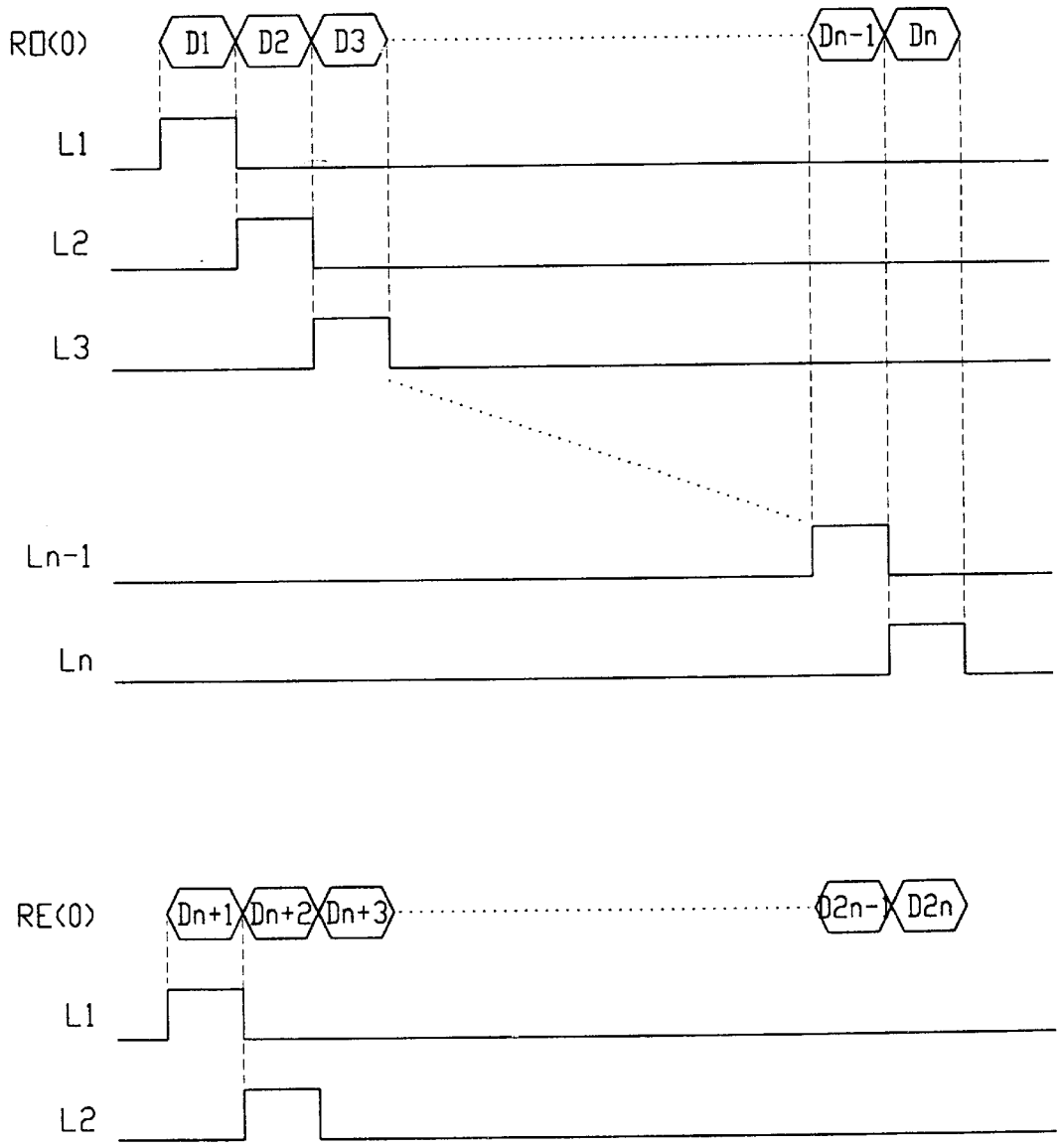
FIG. 10 shows waveforms to illustrate the steps for generating a color signal which has an improved single bank array according to the present invention by means of sequential signal in the first and the second composite block in FIG. 6.

FIG. 10 shows the steps for generating the odd component RO(0) and the even component RE(0) by means of sequential control signals L1–Ln. The first and the second composite block 243 and 244 repeat the above-described operation whenever each of the 2n color signals is inputted.

In the first embodiment of the present invention, the dual bank color signal is converted to the improved single bank color signal. The improved single bank color signal has an odd component and an even component separately and each of the components is inputted to an odd data driver IC and an even data driver IC respectively. Therefore, the LCD panel can be operated simultaleously by the odd data driver IC and the even data driver IC. Accordingly, the panel drive frequency can be reduced by half of the frequency for the LCD which has a single bank array.

Furthermore, as the data driver IC can be arrayed serially on either one part of the LCD panel, upper or lower, by using the improved single bank color signal, a compact design of the data driver IC for the LCD can be achieved.

(2) Second Embodiment

A timing control device according to a second embodiment of the present invention is described with reference to FIGS. 13 to 18.

The timing control device converts a single bank color signal to an improved single bank color signal. A data pulse duration of the improved single bank color signal is twice of a data pulse duration of the single bank color signal. It is also required that n data of the single bank color signal is divided into an odd component and an even component. Based on this concept, the timing control device according to the second embodiment is described in the following.

Figure 13:
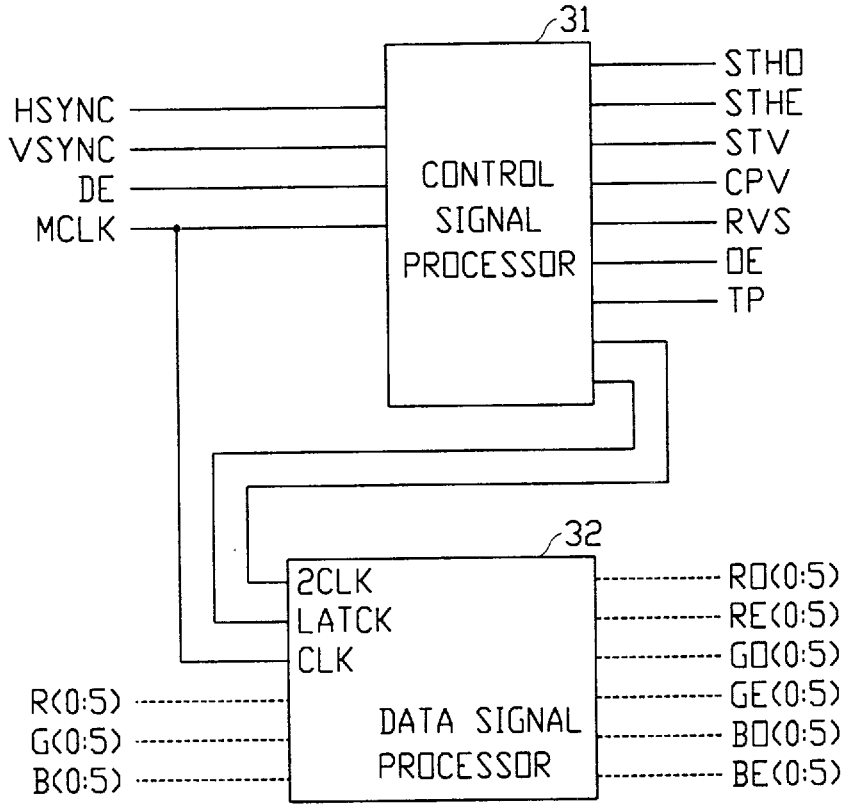
FIG. 13 shows a configuration of a timing control device according to the second embodiment of the present invention.

FIG. 13 shows a configuration of the timing control device for LCD according to the second embodiment of the present invention. The timing control device comprises a control signal processor 31 and a data signal processor 32.

The control signal processor 31 generates control signals required by a gate driver (not shown) and a data driver (not shown) of the LCD after receiving a vertical synchronizing signal VSYNC, a horizontal synchronizing signal HSYNC, a data enable signal DE, and a main clock signal MCLK from an external device such as a graphic controller. In other words, after receiving the input signals, the control signal processor 31 generates a start horizontal signals STHO and STHE, a start vertical signal STV, a gate clock signal CPV, a line reverse signal RVS, a gate-on enable signal OE, a load signal TP, a latch clock signal LATCK, and a divided frequency clock signal 2CLK. The signals generated by the control signal processor 31 are transmitted to the gate driver, the data driver and the data signal processor 32.

The data signal processor 32 receives single bank array color signals R(0:5), G(0:5), B(0:5) and the main clock signal MCLK from an external device such as the graphic controller and also receives the divided frequency clock signal 2CLK and the latch clock signal LATCK. The data signal processor 32 generates improved single bank color signals RO(0:5), RE(0:5), GO(0:5), GE(0:5), BO(0:5) and BE(0:5) after rearranging the data of the single bank color signal.

Figure 14:
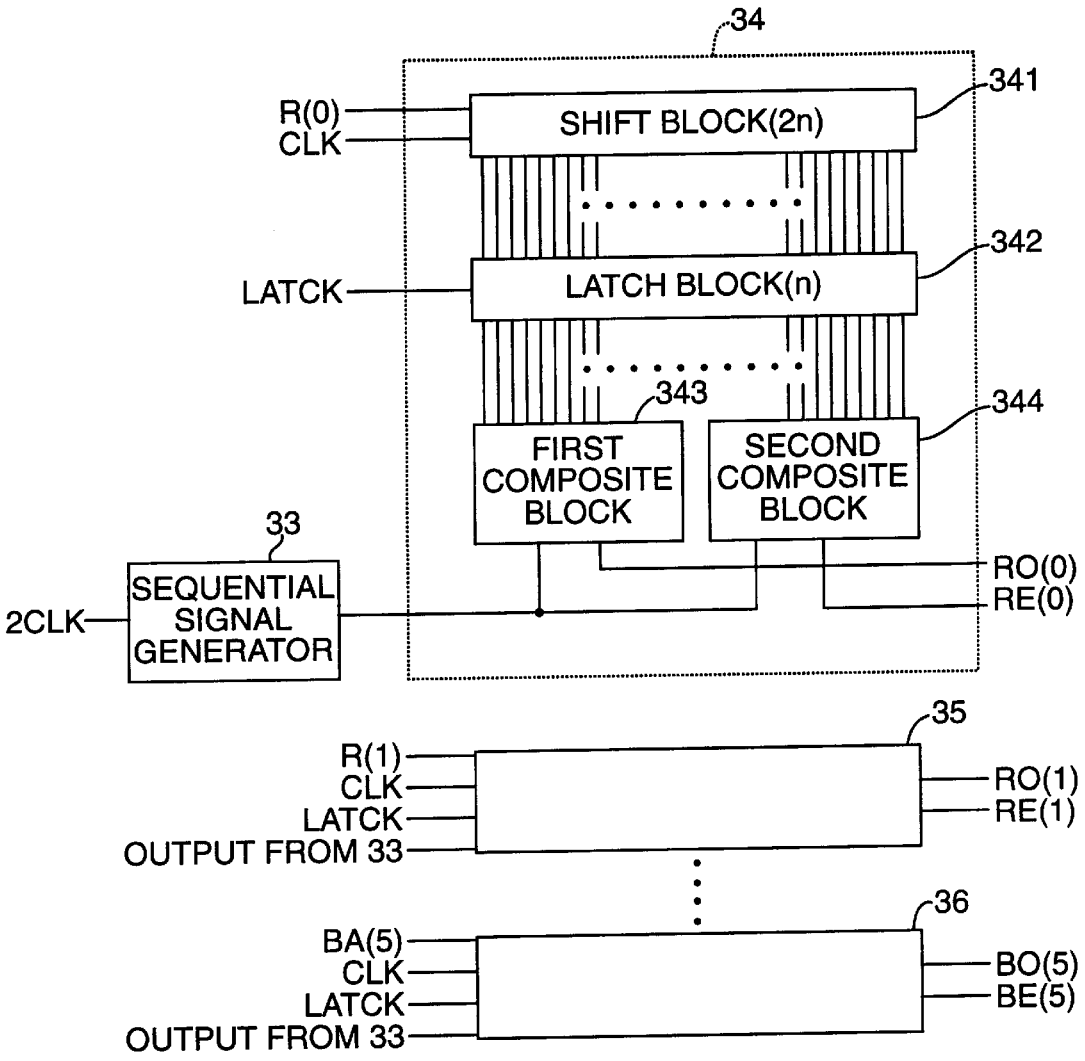
FIG. 14 shows a configuration of the data signal processor in FIG. 13.

FIG. 14 shows the data signal processor 32 of FIG. 13 in further detail.

The data signal processor 32 comprises:

a sequence signal generator 33 for generating sequential control signals L1–Ln after receiving a divided frequency clock signal 2CLK and a data enable signal DE; and a plurality of data processing cells 34 to 36. Each data processing cell generates an odd component and an even component of the improved single bank color signal after receiving a 1 bit line data of the single bank color signal, a sequential control signal L1–Ln from a sequential signal generator 33, a main clock signal CLK and a latch clock signal LATCK.

In the second embodiment of the present invention, 6 bits are alloted to each color of the single bank color signal, and therefore, 18 data processing cells are requird to process three colors, red R, green G and blue B. In FIG. 14, only one cell 34 among eighteen data processing cells is shown in detail and the remaining cells have an internal configuration equal to the data processing cell illustrated above. The data processing cell 34 generates an odd component RO(0) and an even component RE(0) of the improved single bank color signal after receiving R(0) among the single bank color signals.

More specifically, the data processing cell 34 includes a shift block 341, a latch block 342, a first composite block 343 and a second composite block 344. The shift block 341 sequentially shifts and outputs the color signal R(0) after receiving R(0) of 1 bit line and the main clock signal CLK.

The shift block 341 is provided with 2n number of output lines. The latch block 342 classifies every n signals outputted from the shift block 341 and outputs 2n number of data simultaneously in response to the latch clock signal LATCK. A first and a second composite block 343 and 344 receive n number of data respectively from the latch block 343 and also receives sequential control signals L1–Ln from the sequential signal generator 23. The first and the second composite block 343 and 344 respectively output an odd component RO(0) and an even component RE(0) of the improved single bank color signal.

Figure 18:
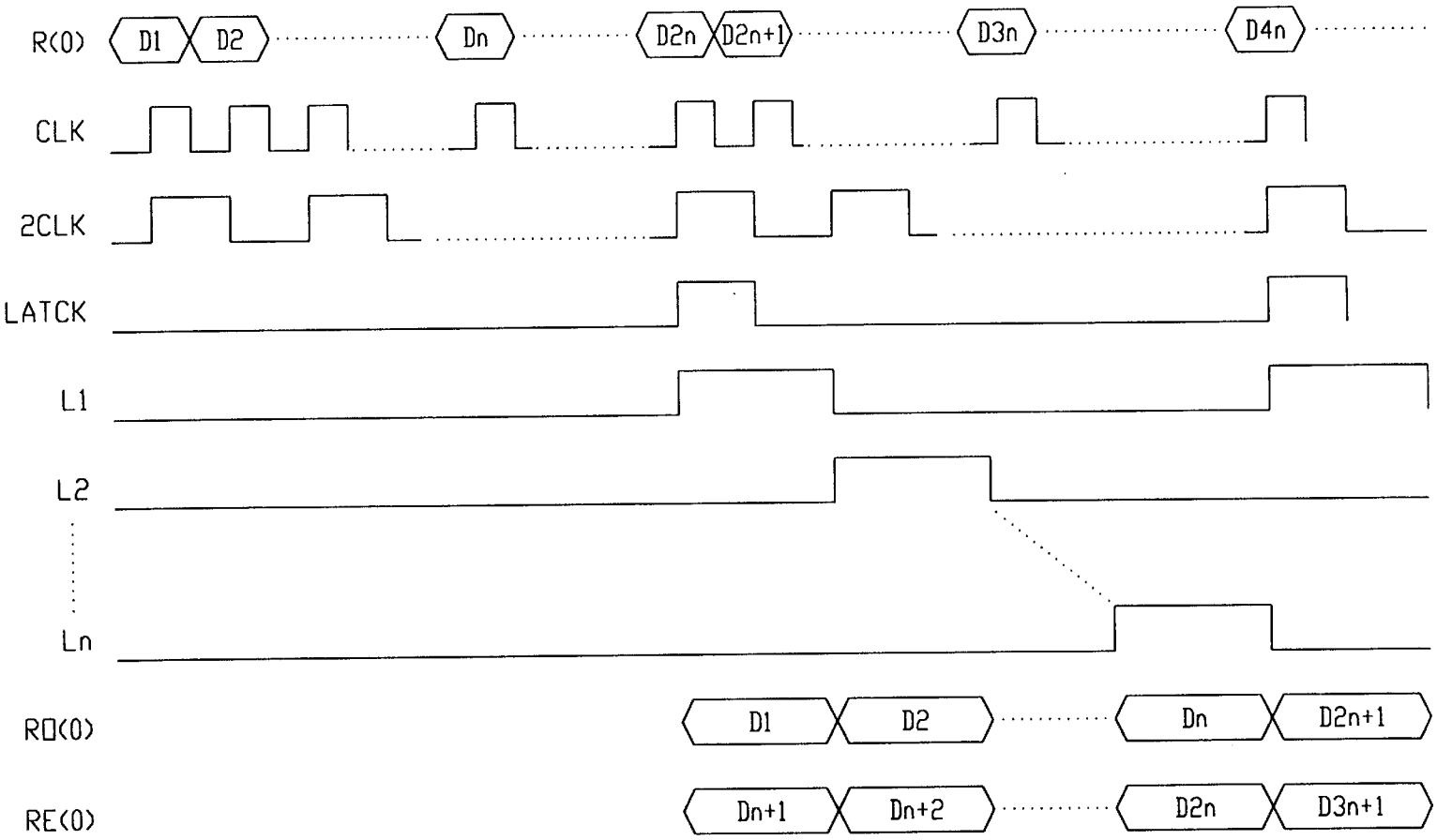
FIG. 18 shows waveforms of the signals from respective components of a timing control device for LCD according to the second embodiment of the present invention.

As shown in FIG. 18, the latch clock signal LATCK has a high level duration in every 2n clock pulses of the main clock signal CLK. The high level duration is equal to one clock pulse duration of the main clock signal. The sequential control signal has a high level duration in every 2n clock pulses of the main clock signal, the high level duration being equal to the duration of two pulses of the main clock signal.

Figure 15:
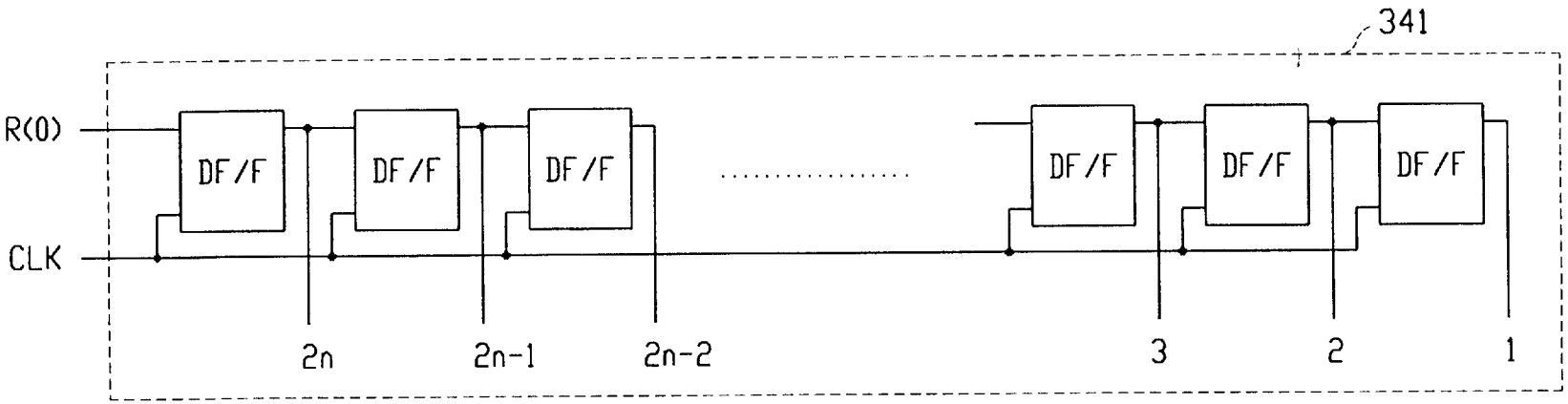
FIG. 15 shows a configuration of the shift block in FIG. 14.

FIG. 15 shows the shift block 342 of FIG. 14 in further detail. The shift block 341 comprises 2n number of D-flipflops which are serially connected with each other. The main clock signal CLK is inputted to a clock terminal of the D-flipflop. A data of the single bank color signal R(0) is inputted to a data terminal of the first D-flipflop. Each of the D-flipflops transmits a signal of the data terminal to an output terminal in response to the clock pulse of the main clock signal CLK.

Therefore, the data of the color signal R(0) is shifted sequentially by the main clock signal CLK and outputted to the latch block 342 simultaneously. The outputs from the D-flipflops comprise 2n number of output terminals 1 to 2n of the shift block 341.

Figure 16:
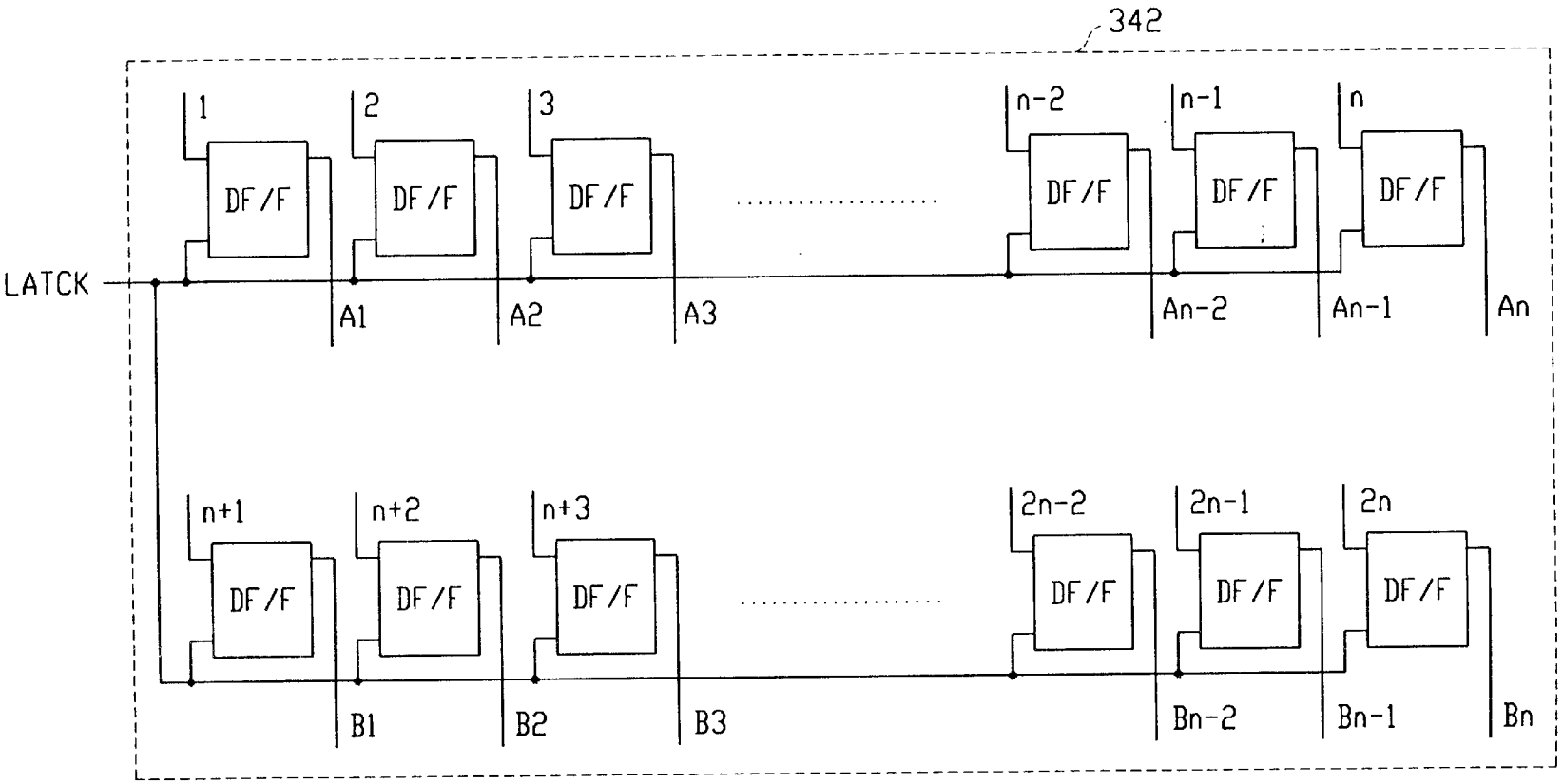
FIG. 16 shows a configuration of the latch block in FIG. 14.

FIG. 16 shows the latch block 342 in further detail.

The latch block 342 comprises 2n number of D-flipflops, whereinto the latch clock signal LATCK is commonly inputted. Each of the upper n number of D-flipflops sequentially receives the data of the terminals 1 to n of the shift block 341. Each of the lower n number of D-flipflops sequentially receives the data of the terminals n+1 to 2n of the shift block 341. Output terminals A1 to An of the latch block 342 is formed by each of output terminals of the upper n number of D-flipflops and output terminals B1 to Bn of the latch block 342 are formed by each of output terminals of the lower n number of D-flipflops. Each of the 2n number of D-flipflops transmits input data to the output terminal whenever a clock pulse of the latch clock signal LATCK is inputted. The output terminal of the D-flipflop sustains the data of the output terminal whenever the next clock pulse of the latch clock signal is inputted.

As aforementioned, a high level duration within every 2n clock pulses of the main clock signal MCLK exists in the latch clock signal LATCK. Therefore, the data of the output terminals A1 to An and E1 to Bn are sustained during the duration of 2n clock pulses of the main clock signal MCLK. The first composite block 343 and the second composite block 344 carry out data rearranging during the output data of the latch block 342 is sustained.

Figure 17:
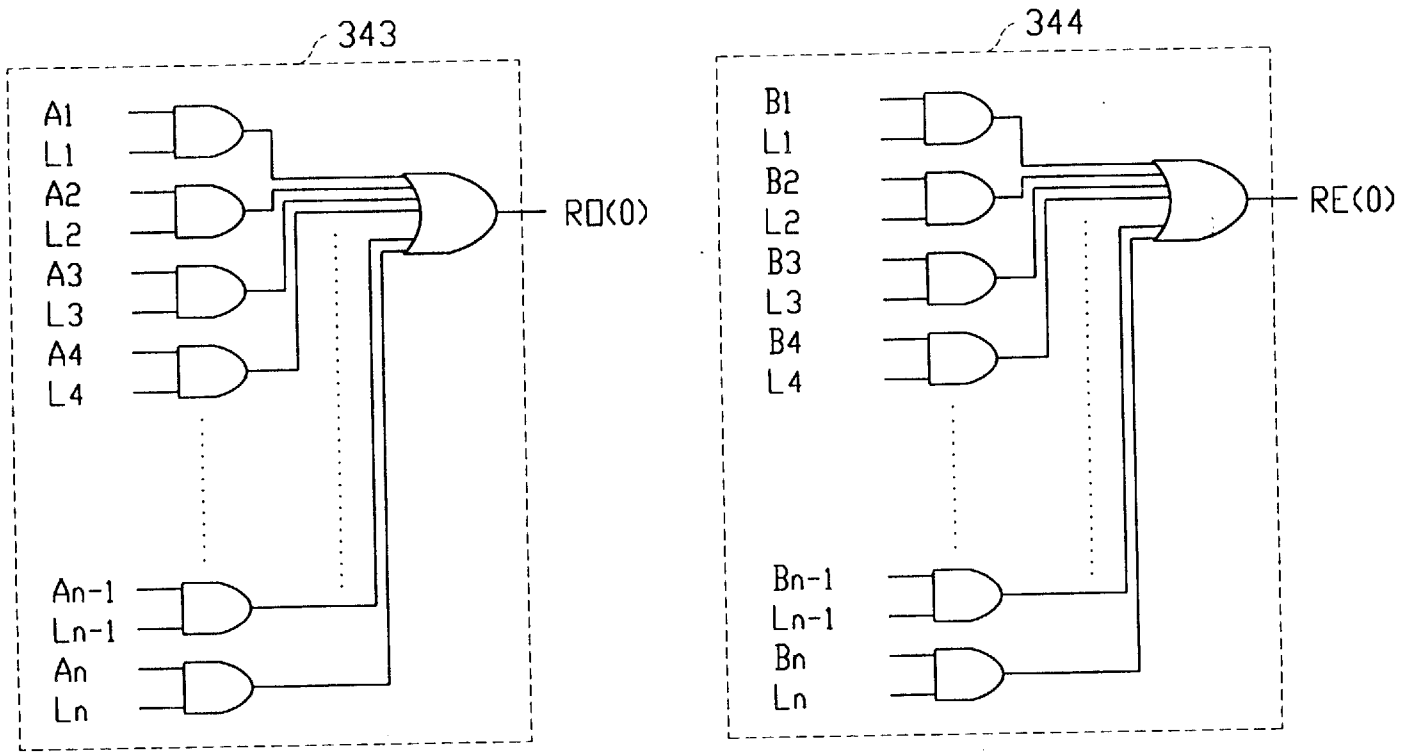
FIG. 17 shows a configuration of the first and the second composite block in FIG. 14.

FIG. 17 shows the first composite block 343 and the second composite block 344 in further detail.

The first composite block 343 comprises n number of AND gates and an OR gate which receives output data from the AND gates. Similarly, the second composite 344 comprises n number of AND gates and an OR gate which receives output data from the AND gates. Each of AND gates of the first and the second composite block 343 and 344 has two input terminals. The data of the output terminals A1 to An of the latch block 342 are sequentially inputted into one of the input terminals of the AND gate of the first composite block 343. The sequential control signal L1 to Ln are sequentially inputted the other input terminals of the AND gate of the first composite block 343.

The data of the output terminals B1 to Bn of the latch block 342 are sequentially inputted into one of the input terminals of the AND gate of the second composite block 344. The sequential control signal L1 to Ln are sequentially inputted the other input terminals of the AND gate of the second composite block 344.

In FIG. 18, data D1 to D2n of the single bank color signal RO(0) are sequentially sustained in output terminals A1 to An and B1 to Bn of the latch block 342 in response to the first clock pulse of the latch clock signal LATCK. The data D1 to Dn in the output terminals A1 to An are sustained during a duration of 2n number of clock pulses of the main clock signal MCLK. The data Dn+1 to D2n in the output terminals B1 to Bn are sustained during a duration of 2n clock pulses of the main clock signal MCLK.

Each of the sequential control signals L1 to Ln has a high level duration which is repeated in every 2n number of clock pulses of the mainclock signal MCLK and the high level durations of two adjacent sequential control signals are positioned sequentially.

An AND gate of the first composite block 343 carries out a logical AND function of two input data, and thus, a corresponding data of the output terminal of the latch block 342 is transmitted to a terminal of the AND gate during the high level duration of corresponding sequential control signal. In this state, the pulse duration of the data outputted from each of the AND gates is extended by two times because the high level duration is equal to two clock pulse duration of the main clock signal MCLK.

The OR gate of the first composite block 343 carries out a logical OR function for the outputs of n number of AND gates and then outputs the result as an odd component RO(0) of the improved single bank color signal.

In FIG. 18, the first composite block 343 processes odd numbered n data D1–Dn, D2n+1–D3n, . . . of the single bank color signal R(0) and the second composite block 344 processes even numbered n data Dn+1–D2n, D3n+1–D4n, . . . of the single bank color signal R(0). An odd component RO(0) and an even component RE(0) obtained in the first and the second composite block 343 and 344 are inputted respectively to the odd data driver ICs and the even data driver ICs. Accordingly, the frequency for driving the LCD panel is reduced and a compact design of the LCD panel can be achieved.

The timing control device for LCD according to the second embodiment of the present invention is distinguished from the first embodiment in that the timing control device of the second embodiment converts the single bank color signal to the improved single bank color signal.

(3) Third Embodiment

A timing control device according to a third embodiment of the present invention is described with reference to FIGS. 19 to 22.

The timing control device according to the third embodiment of the present invention is similar to the second embodiment in that both of them converts the single bank color signal to the improved single bank color signal. However, the third embodiment is distinguished from the second embodiment in that the shift block is not used in the third embodiment.

Figure 19:
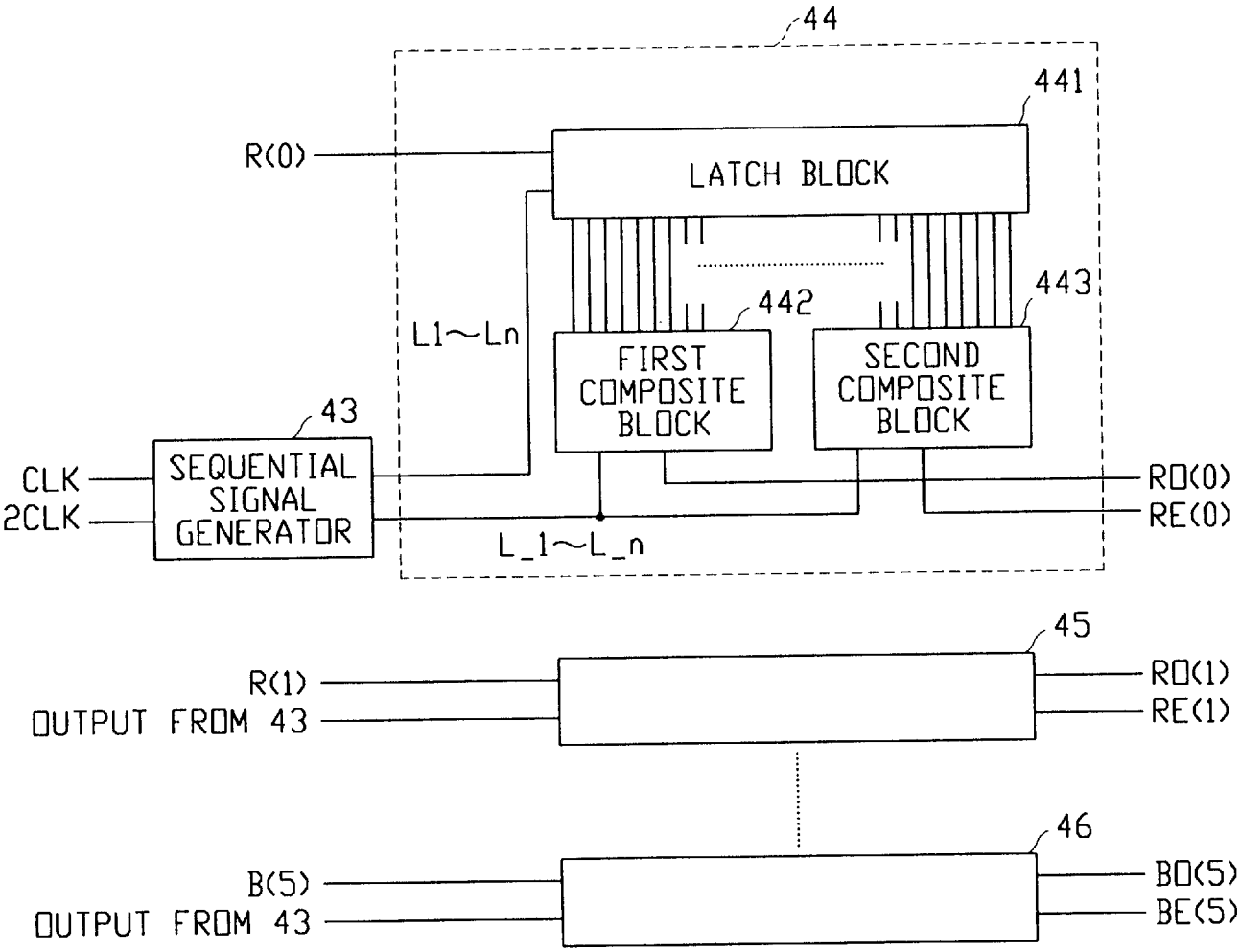
FIG. 19 shows a configuration of the data signal processor according to the third embodiment of the present invention.
Figure 20:
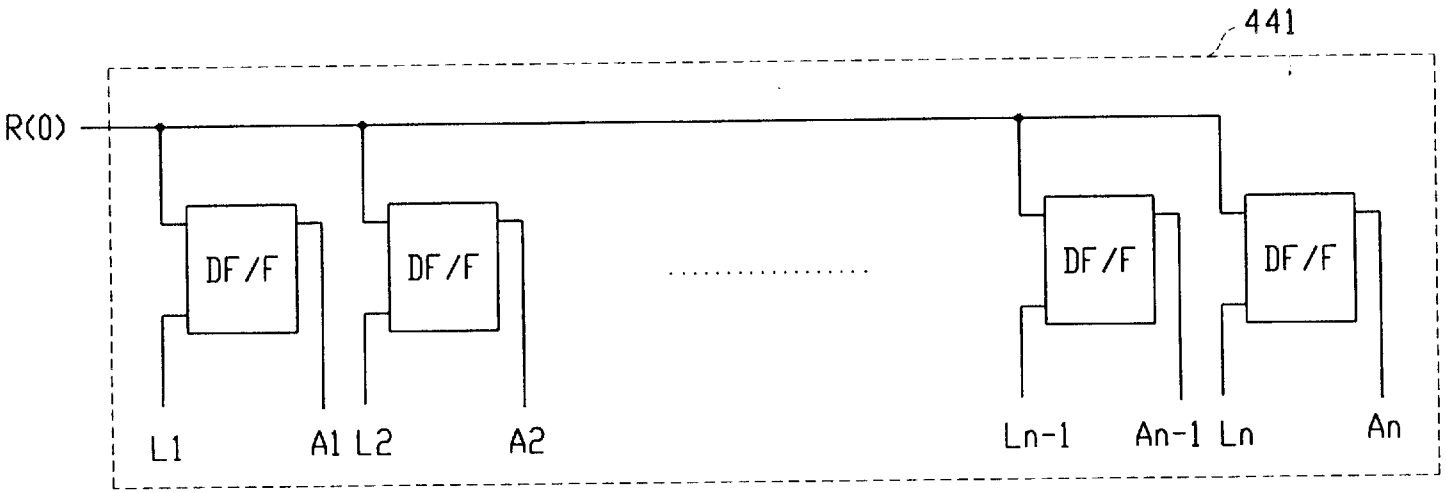
FIG. 20 shows a configuration of the latch block in FIG. 19.
Figure 21:
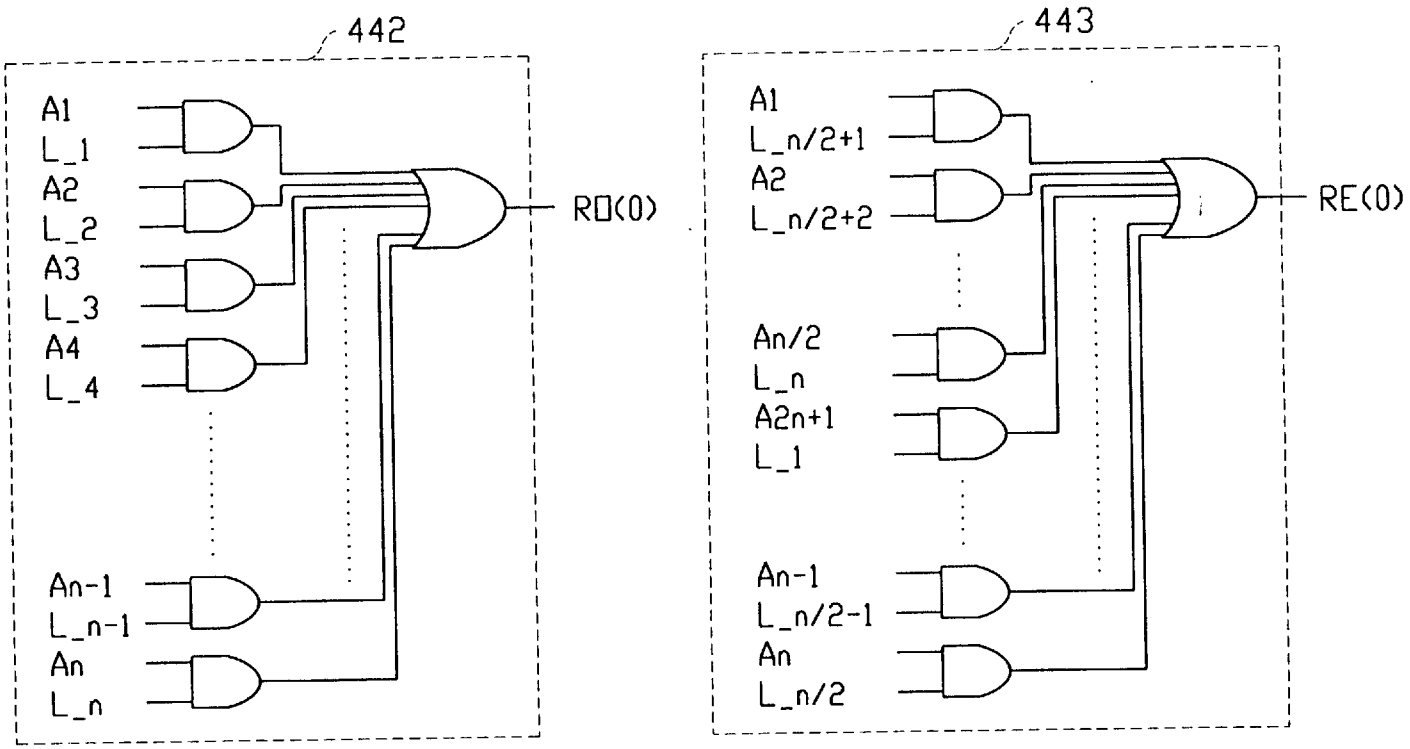
FIG. 21 shows a configuration of the first and the second composite block in FIG. 19.

The timing control device of the third embodiment has similar configuration to that of the second embodiment as shown in FIG. 13. As shown in FIGS. 19 to 21, the detail configuration of a data signal processor of the third embodiment is different from that of the second embodiment.

FIG. 19 shows a data signal processor according to the third embodiment of the present invention in detail.

In the timing control device of the third embodiment, a data signal processor comprises: a main clock signal MCLK; a sequential signal generator 43 for generating latch control signals L1–Ln and sequential control signals L_1–L_n after receiving a half frequency clock signal 2CLK and a data enable signal DE; and a plurality of data processing cells 44–46.

Each data processing cell generates an odd component and an even component of an improved single bank color signal according to the present invention after receiving; a data of 1 bit line of the single bank color signal, and latch control signals L1–Ln and sequential control signals L_1–L_n which are outputted from the sequential signal generator 43.

In the third embodiment of the present invention, 6 bits are alloted to each color of the single bank color signal, and therefore, 18 data processing cells are requird to process three colors, red R, green G and blue B. In FIG. 19, only one cell 44 among eighteen data processing cells is shown in detail and the remaining cells have an internal configuration equal to the data processing cell shown in the drawings. The data processing cell 44 generates an odd component RO(0) and an even component RE(0) of the improved single bank color signal after receiving a single bank color signal R(0).

More specifically, the data processing cell 44 includes a latch block 441, a first composite block 442 and a second composite block 443. The latch block 441 outputs a data of the color signal R(0) in response to the latch control signal L1–Ln after receiving the color signal R(0) of 1 bit line and latch control signals L1–Ln. n number of output lines are provided in the latch block 441. The latch control signals L1–Ln are generated in the sequential signal generator 43 by means of the main clock signal CLK.

Figure 22:
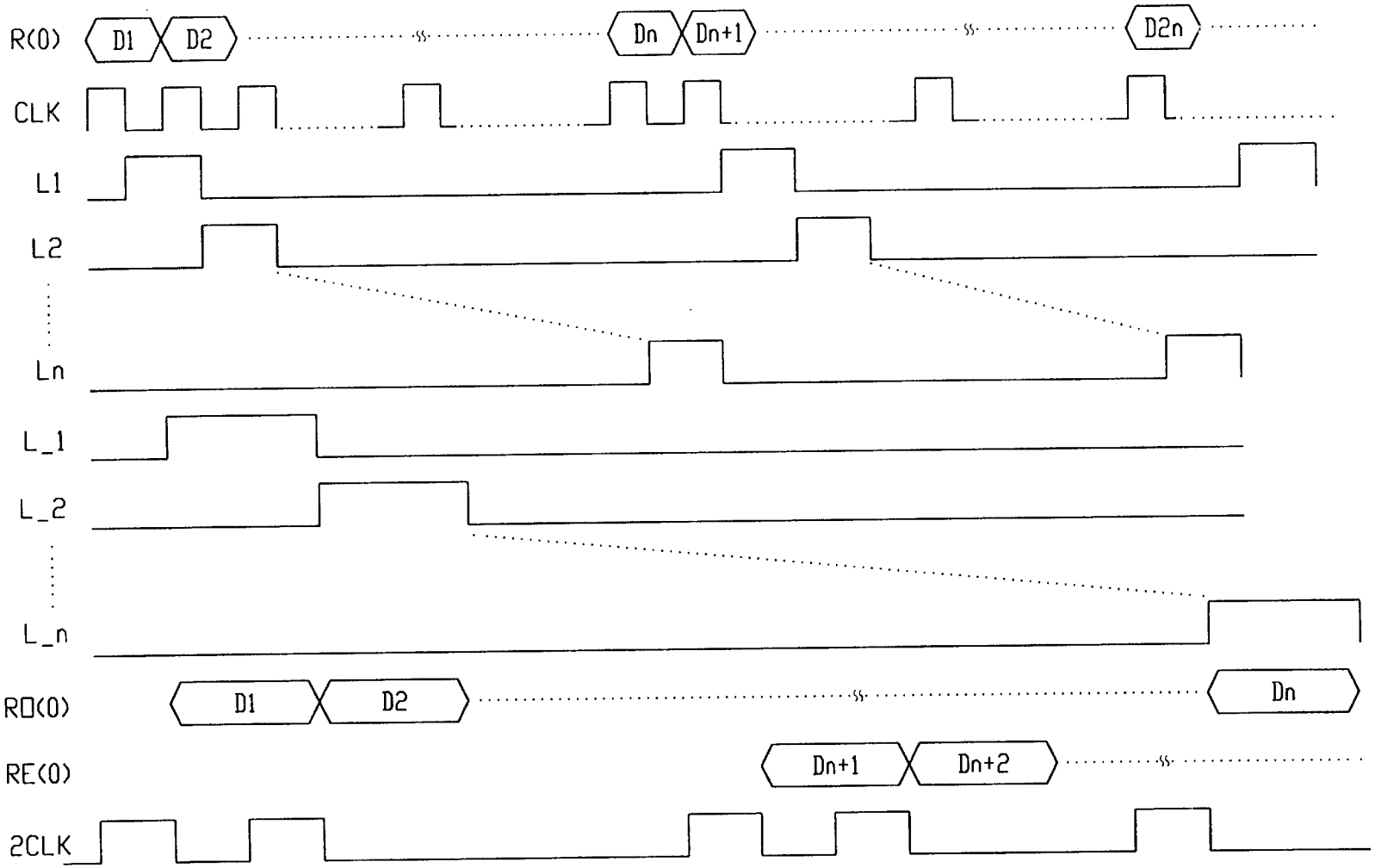
FIG. 22 shows waveforms of the signals from respective components of a timing control device for LCD according to the third embodiment of the present invention.

As shown in FIG. 22, each of the latch control signals L1–Ln has a high level duration which is repeated in every n clock pulses of the main clock signal CLK. The high level duration is equal to one clock pulse duration of the main clock signal CLK and the high level duration of two adjacent latch control signals are positioned sequentially.

The first and the second composite block 442 and 443 generates an odd component RO(0) and an even component RE(0) of the improved single bank color signal after rearranging the data from the latch block 441 according to sequential control signals L_1–L_n.

FIG. 20 shows the latch block 441 of FIG. 19 in further detail.

In FIG. 20, the latch block 441 comprises n number of D-flipflops. A single bank color signal R(0) is commonly inputted to a data terminal of each D-flipflop. On of the latch control signals L1–Ln is sequentially inputted to each clock terminal.

The output terminals of n number of D-flipflops form output terminals A1–An of the latch block 441.

Each of the D-flipflops transmits a data of the data terminal to the output terminal whenever a clock pulse of corresponding latch control signal is inputted, and susteins current data in the output terminal until the next clock pulse of the latch control signal is inputted.

In FIG. 22, a data D1 of color signal R(0) is latched in the first D-flipflop by a first high level of the latch control signal L1. A data D2 of color signal R(0) is latched in the second D-flipflop by the first high level of the latch control signal L2. In the same manner, a data Dn of color signal R(0) is latched in the nth D-flipflop by the first high level of the latch control signal Ln.

The data Dn+1 of color signal R(0) is latched by a second high level in the first D-flipflop. Therefore, at the output terminal A1 of the first D-flipflop, the data D1 of color signal R(0) is sustained from the time of input of the first high level of the latch control signal L1 untill the second high level is inputted. The same operation as above is carried out by the other D-flipflop.

The data of the output terminals A1–An of the latch block 441 are commonly inputted to the first composite block 442 and the second composite block 442, and thus, the terminal of the latch block 441 is described as '2n line' in FIG. 19.

FIG. 21 shows the first and the second composite block 442 and 443 in detail.

The first composite block 442 and the second composite block respectively comprises n number of AND gates and an OR gate which receives outputs from the AND gate. Two input terminals are provided to each of the first and the second domposite blocks 442 and 443.

Each one of n number of sequential control signals L_1–L_n is sequentially inputted to an input terminal of the AND gates in the first composite block 442. Each one signal of n number of output terminals A1–An of the latch block 441 is sequentially inputted to the other input terminals of the AND gate.

In FIG. 22, each of n sequential control signals L_1–L_n has a high level duration in every 2n number of clock pulses of the main clock signal CLK, the high level duration being equal to the duration of two clock pulses of the main clock signal CLK. The high levels of any adjacent sequential control signals are positioned sequentially with each other.

The first composite block 442 in FIG. 21 carries out logical AND function of the sequential control signals L_1–L_n and the signals from the output terminals A1–An of the latch block 441, and generates an odd component RO(0) of the improved single bank color signal shown in FIG. 22 by means of a logical OR function of the result of the logical AND function. A data duration extended by twofold of the odd component RO(0) is obtained by the high level duration of the sequential control signal.

Each signal of n number of output terminals A1–An of the latch block 441 is inputted sequentially to an input terminal of the AND gate of the second composite block 443. n number of sequential signals L_1–L_n are inputted to the other input terminals of the AND gate. In this state, the input sequence of the sequential control signal L_1–L_n is different from that of the first composite block 442.

As shown in FIG. 21, the sequential control signals are inputted to the AND gates consecutively, starting from a first signal L_n/2+1 of the latter half and ending at the last signal L_n/2 of the former half.

When n number of single bank color signal data are latched in the latch block 441, before the next n data being latched, the second composite block 443 generates an even component of the improved single bank color signal by means of a logical OR function of the latched data.

According to the adjusted input sequence of the sequential control signals, the first composite block 442 and the second composite block 443 respectively processes odd numbered n data and even numbered n data of the single bank color signal.

As described above, the timing control device according to the third embodiment of the present invention generates the improved single bank color signal by means of the logical operation of the first or the second composite block after latching the single bank color signal, but before starting the next latching, in response to the latch control signal.

Consequently, the timing control device according to the third embodiment of the present invention does not require a shift block and provides a simplified circuit.

(4) Fourth Embodiment

A timing control device according to a fourth embodiment of the present invention is described with reference to FIGS. 23 to 32.

The timing control device according to the fourth embodiment generates an improved single bank color signal after receiving either of a dual bank color signal or a single bank color signal. Further, by using the timing control device according to the fourth embodiment, not only the number of the control signal is reduced, but also the number of gate devices to be used is decreased.

Figure 23:
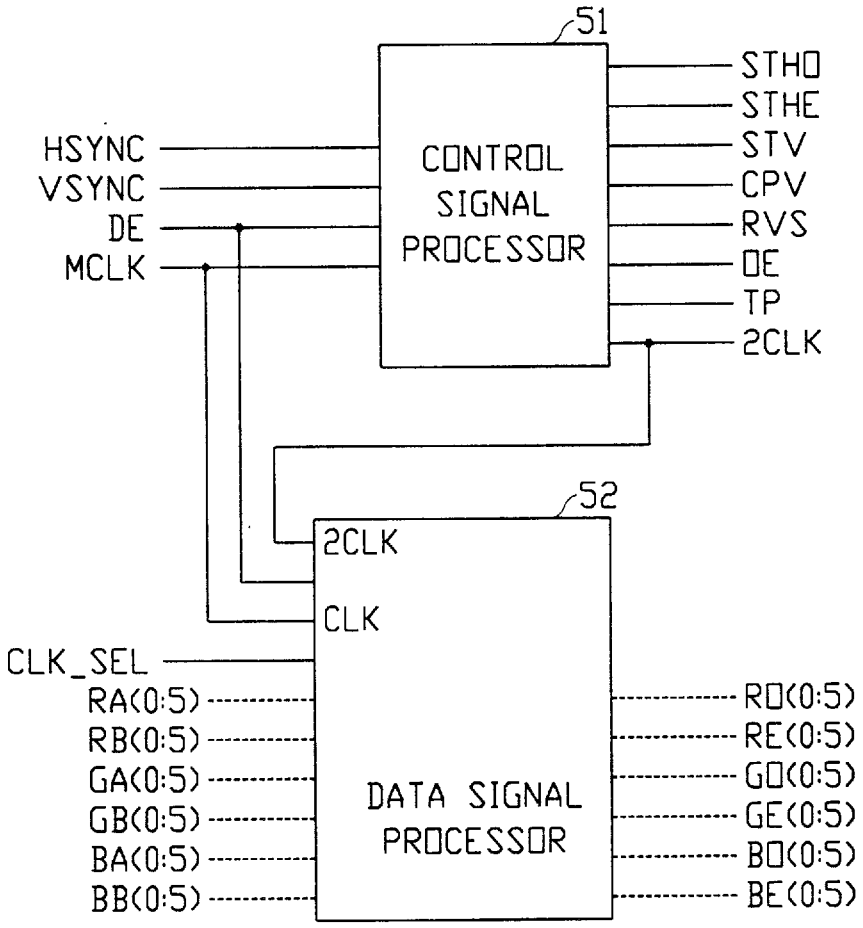
FIG. 23 shows a configuration of a timing control device for LCD according to the fourth embodiment of the present invention.

As shown in FIG. 23, the timing control device for LCD according to the fourth embodiment of the present invention comprises a control signal processor 51 and a data signal processor 52.

The control signal processor 51 generates control signals required to a gate driver and a data driver after receiving a vertical synchronizing signal VSYNC, a horizontal synchronizing signal HSYNC, a data enable signal DE, and a main clock signal MCLK from an external device such as a graphic controller. In other words, the control signal processor 51, by using of input signals, generates start horizontal signals STHO and STHE, a start vertical signal STV, a gate clock signal CPV, a line reverse signal RVS, a gate-on enable signal OE, a load signal TP, and a half frequency clock signal 2CLK. The signals generated in the control signal processor 51 are transmitted to a gate driver (not shown), a data driver (not shown) and the data signal processor 52 of an LCD.

The data signal processor 52 receives: a color signal and a main clock signal MCLK from an external device such as a graphic controller; a clock select signal CLK_SEL; and a half frequency clock signal from the control signal processor 51.

The clock select signal CLK_SEL indicates whether the input color signal to the data signal processor 52 is a dual bank type or a single bank type which depends on the type of the graphic controller. Shown in FIG. 23 is a dual bank type.

In the dual bank type, a color signal is divided into two signals of an odd component and an even component. For example, in FIG. 23, two signals RA(0:5) and RB(0:5) are provided for a red signal, wherein (0:5) represents that the signal RA consists of 6 bits and indicates a multiple gray level of the color signal. If the color signal is a single bank type, three signals RA(0: 5), GA(0:5) and BA(0:5) are inputted to the data signal processor 52.

The data signal processor divides the frequency of the above described color signals and generates odd data [RO (0:5), GO(0:5), BO(0:5)] and even data [RE(0:5), GE(0:5), BE(0:5)] of the color signal after arranging the data.

Figure 24:
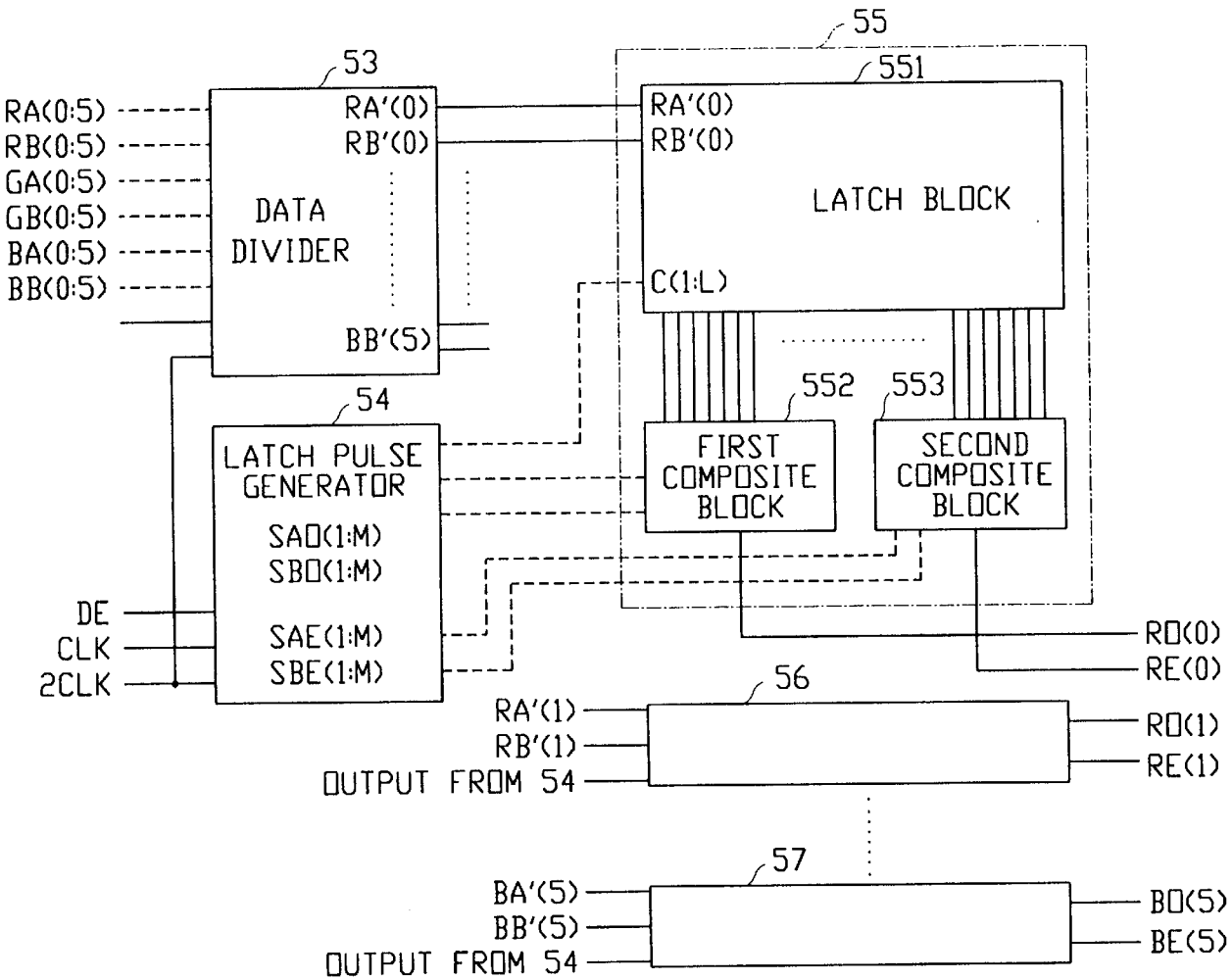
FIG. 24 shows a configuration of the data signal processor in FIG. 23.

FIG. 24 shows the data signal 52 of FIG. 23 in further detail. As shown in FIG. 24, the data signal processor 52 comprises a data frequency divider 53, a latch pulse generator 54 and a plurality of data processing cells 55 to 57. The data processing cell 55 comprises a latch block 551, a first composite block 552 and a second composite block 553.

If a color signal is assumed to consist of 6 bit, 18 data processing cells are required for a data frequency divider. In the fourth embodiment of the present invention, only one processing cell 55 is illustrated in detail in order to avoid unnecessary complexity of the drawings. Thus, the data signal processor 52 illustrated in FIG. 23 actually comprises a data frequency, a latch pulse generator and 18 data processing cells. The quantitative numbers correspond to bit numbers of color signals.

Referring to FIG. 24, the data frequency divider 53 receives a color signal of corresponding bit, a clock select signal CLK_SEL and a half frequency clock signal 2CLK. Only when the color signal from the clock select signal CLK_SEL is of the single bank type, the data frequency divider 53 divides each inputted color signal in response to the half frequency clock signal 2CLK and further divides odd data and even data, thereby generating a color signal of the dual bank type.

If the inputted color signal is of the dual bank type, the data frequency divider 53 outputs the color signal without any processing. A conversion to a dual bank color signal according to the clock select signal CLK_SEL can be achieved by means of a switching device such as a multiplex (not shown) and a detail illustration of the circuit is not recited in this description as this can easily be understood by a person skilled in this art of the present invention.

For example, when color signals RA(0), GA(0) and BA(0) of single bank type are inputted to the data frequency divider 53, the data frequency divider 53 generates color signals RA'(0), RB'(0), GA'(0), GB'(0), BA'(0) and BB'(0) of dual bank type. The circuit diagram shown in FIG. 25 illustrates a circuit for converting the single bank color signal RA(0) to the dual bank color signal in the data frequency divider 53.

Figure 25:
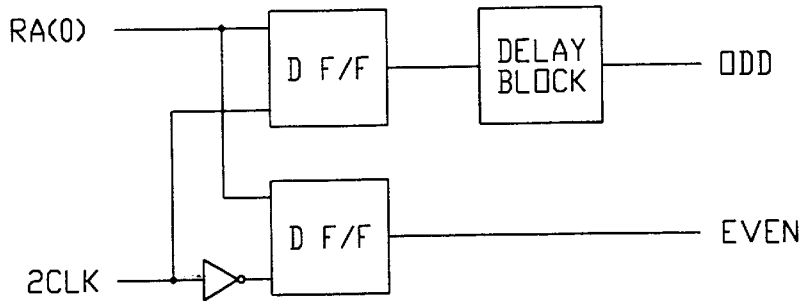
FIG. 25 shows a configuration of a circuit for converting a signal of a single bank array to a signal of a dual bank array in the data divider in FIG. 23.

In FIG. 25, a single bank color signal RA(0) is commonly inputted to data terminals of the two D-flipflops. A half frequency clock signal 2CLK is inputted to a clock terminal of the upper D-flipflop and a reverse signal of the half frequency clock signal is inputted to the lower D-flipflop.

A delay block is connected to an output terminal of the upper D-flipflop. The upper D-flipflop latches the single bank color signal RA(0) to the output terminal at a rising edge of the half frequency clock signal. The lower D-flipflop latches the single bank color signal RA(0) to the output terminal at a falling edge of the half frequency clock signal.

Accordingly, an odd data ODD and an even data EVEN of the single bank color signal RA(0) are divided with each other. As the period of the half frequency clock signal 2CLK is two times of the period of the main clock signal MCLK, each of the odd data ODD and the even data EVEN has a period twice of the data period of the single bank color signal.

The delay block delays the odd data for a required time to adjust the starting points of odd data ODD and even data EVEN to be coincident.

Figure 31:
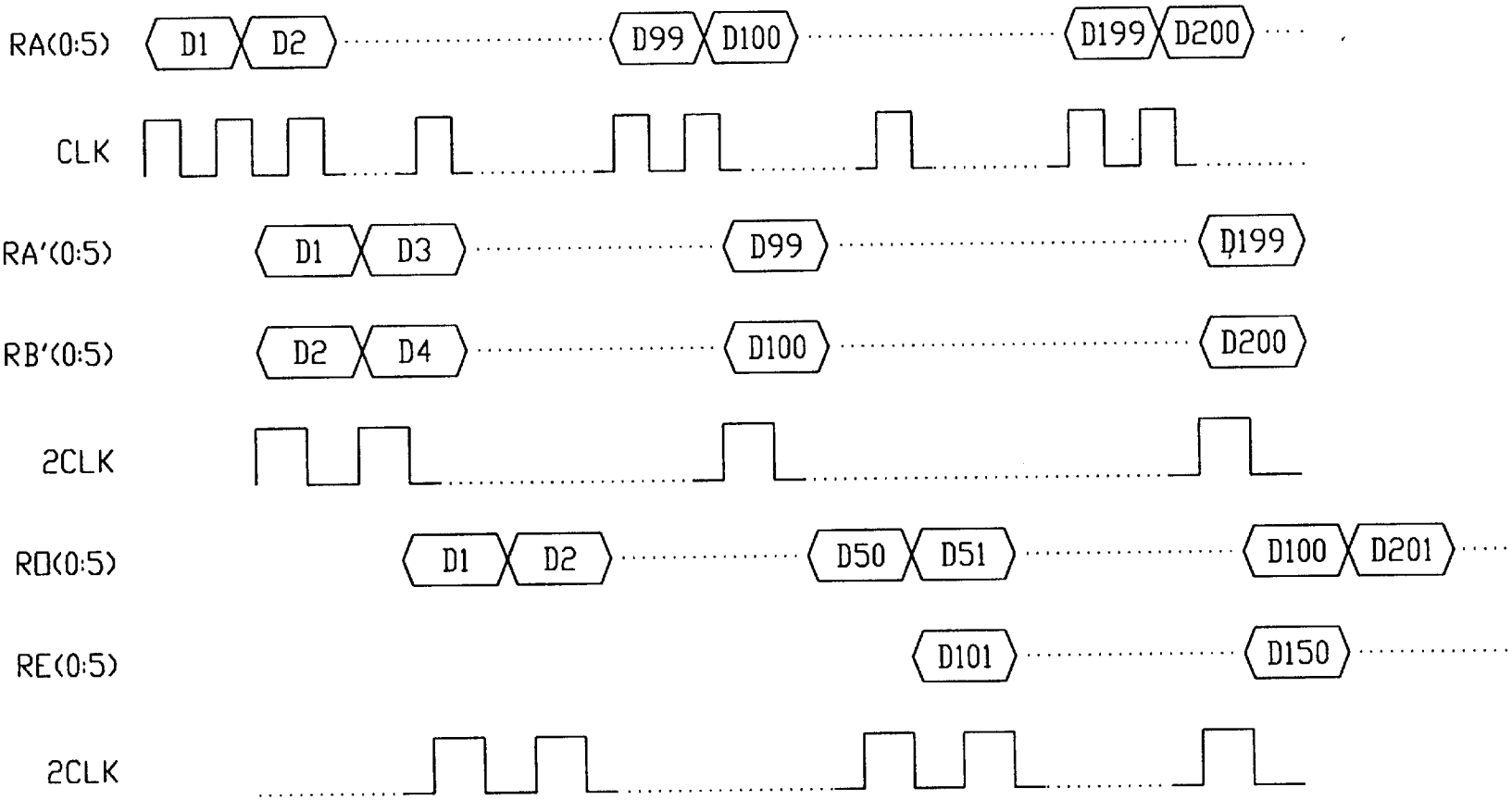
FIG. 31 shows waveforms to illustrate steps for generating a color signal of improved single bank array according to the present invention from a color signal of single array.

FIG. 31 shows waveforms of a color signal RA(0:5) of the single bank type and color signals RA'(0:5) and RB'(0:5) of dual bank type and also illustrates one of 6 bit of color signals RA(0:5), RA'(0:5) and RB(0:5). In FIG. 31, RO(0:5) and RE(0:5) are examples of an odd component and an even component of the improved single bank color signal respectively, the components being generated in the data processing cell 55.

The latch pulse generator 54 receives the main clock signal CLK and the half frequency clock sinal 2CLK and generates a latch control signal [C(1:L)] and adding control signals [SAO(1:M), SBO(1:M), SAE(1:M), SBE(1:M)], wherein L represents the number of flipflops being used in the latch block 551 and M is a dependent variable which is determined by the efficiency of hardware design. The value of M is smaller than L. In the fourth embodiment of the present invention, L is given the value of 36 and M is given 26. For reference, the number of channels of data driver ICs is 100.

As aforementioned, a data frequency divider is provided with 18 data processing cells.

In FIG. 24, the data processing cell 55 processes color signals RA'(0) and RB'(0) generated in the data frequency divider 53.

More specifically, the latch block 551 selects, in accordance with the latch control signal [C(1:L)], the color signals RA'(0) and RB'(0) generated in the data frequency divider 53 so that RA'(0) and RB'(0) may be arranged in a sequence. The output of the latch block 551 after the selection is transmitted to the first composite block 552 and the second composite block 553.

Each of the first composite block 552 and the second composite block 553 performs a logical OR function for the output of the latch block 551 according to the adding sequence which is determined by adding control signals of: [SAO(1:M), SBO(1:M)] in case of the first composite block 552 and [SAE(1:M), SBE(1:M)] in case of the second composite block 553.

As a result, in regard to color signals [RA(0), RB(0)] of corresponding bit, an odd component RO(0) is generated in the first composite block 552 and an even component RE(0) is generated in the second composite block 553. In this state, the latch control signal of the latch block 551 and the adding control signals of the first and the second composite block 552 and 553 are predetermined so that a data lines of the odd data RO(0) and the even data RE(0) appear alternately up to the number of channels of the data driver IC.

Figure 30:
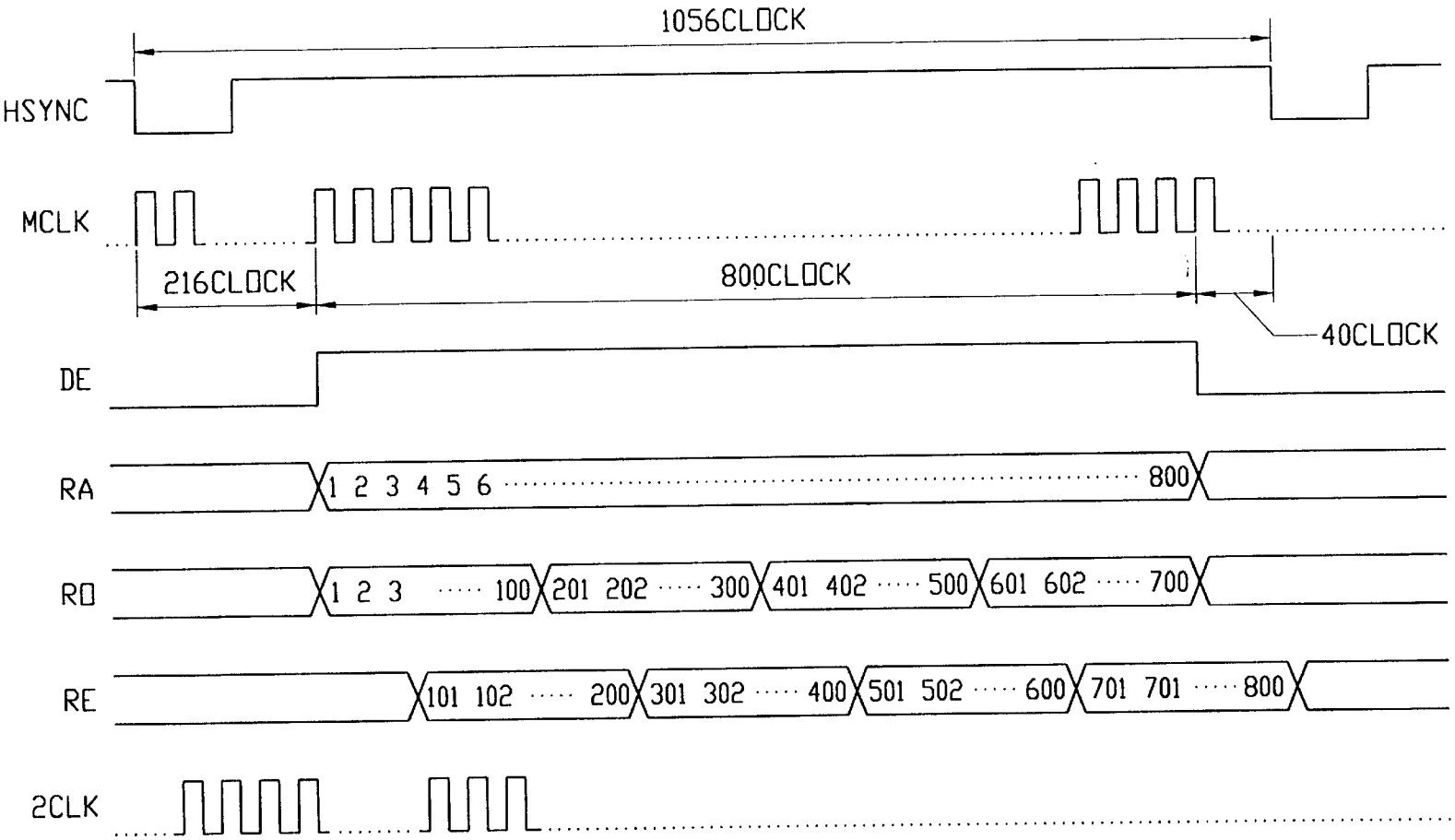
FIG. 30 shows waveforms to illustrate relations between a vertical synchronizing signal, a horizontal synchronizing signal, a data enable signal, a color signal of single bank array, and a color signal of improved single bank array, those signals being used in the timing control device for LCD according to the fourth embodiment of the present invention.

FIG. 30 illustrates a horizontal synchronizing signal HSYNC, a main clock signal MCLK, a data enable signal DE, a color signal RA of single bank type, an odd component RO of the color signal RA, an even component RE of the color signal RA and a half frequency clock signal 2CLK.

FIG. 30 illustrates waveforms of each of the signals in case of a hundred channels for a data driver IC (not shown) of an LCD. In the odd component RO and the even component RE of the color signal according to the prosent invention in FIG. 30, the data line of the color signal RA afternates in a unit of a hundred lines. And the data sustaining period of the odd component RO and the even component RE are two times of that of the single bank color signal RA.

As previously described with reference to FIG. 11, the odd component RO is inputted to an odd numbered data driver IC, while the even component RE is inputted to an even numbered data driver IC. The case is same for the other color signals.

Each of the data driver ICs drives an LCD panel in a dual mode by means of the odd component and the even component. Since the data sustaining period in this case is two times longer that the single bank type, an equal desplay operation is possible by use of only half of the drive frequency of the single bank type.

Figure 26:
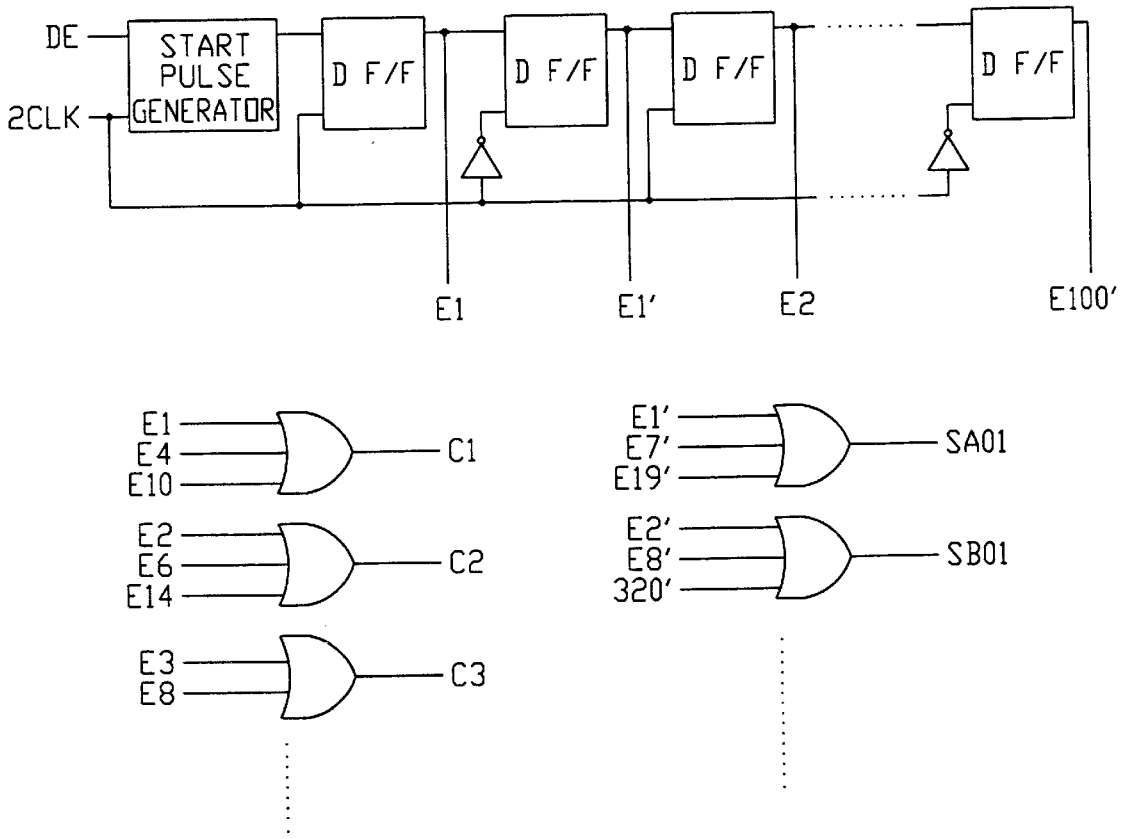
FIG. 26 shows a configuration of the latch pulse generator in FIG. 23.

FIG. 26 illustrates the latch generator 54 in FIG. 24 in further detail.

In FIG. 26, the latch pulse generator 54 includes:

a block for generating a first sequential control signals E1–E100 and a second sequential control signals E1'–E100';

a first OR block for generating a latch control signal by means of the first sequential control signals E1–E100; and a second OR block for generating an adding control signal by means of the second sequential control signals E1'–E100'.

When the number of channels of the data driver IC for an LCD is assumed to be n, the above blocks consists of a start pulse generator and 2n number of D-flipflops which are serially connected with each other.

The start pulse generator receives the data enable signal DE and the half frequency clock signal 2CLK and then generates a start pulse having a high level duration which repeats in every n number of clock pulses of the half frequency clock signal 2CLK. The start signal is inputted to the first D-flipflop.

The half frequency clock signal 2CLK is inputted to a clock terminal of the odd numbered D-flipflop. A reverse signal of the half frequency clock signal is inputted to a clock terminal of the even numbered D-flipflop.

The odd numbered D-flipflop latches a data terminal signal to the output terminal at a rising edge of the half frequency clock signal. The even numbered D-flipflop latches the data terminal signal to the output terminal at a polling edge of the half frequency clock signal.

Each of the output terminal signals of the odd numbered D-flipflop is transmitted to the next flipflop and at the same time outputted as the first sequential control signals E1–E100. Each of the output terminal signals of the even numbered D-flipflop is transmitted to the next flipflop and at the same time outputted as the second sequential control signals E1'–E100'. The first and the second sequential control signals are latched with the half frequency clock signal at the rising edge and the polling edge, and therefore, there is a phase difference between the two sequential control signals corresponding to an half clock pulse of the half frequency clock signal.

n number of the first sequential control signal are inputted to the first OR block and a latch control signal is generated by a logical sum of more than two of the first sequential control signal. In a similar manner, n number of the second sequential control signal are inputted to the second OR block and an adding control signal is generated by a logical sum of more than two of the second sequential control signal.

As more than two of the sequential control signal are added to generate the latch control signal or the adding control signal, the number of the latch control signal or the adding control signal is smaller than the channel number n.

Consequently, the number of both flipflops and gate devices can be reduced.

The data processing cell 55 in FIG. 24 is described in detail with reference to FIGS. 27 to 29 and FIG. 32.

Figure 27:
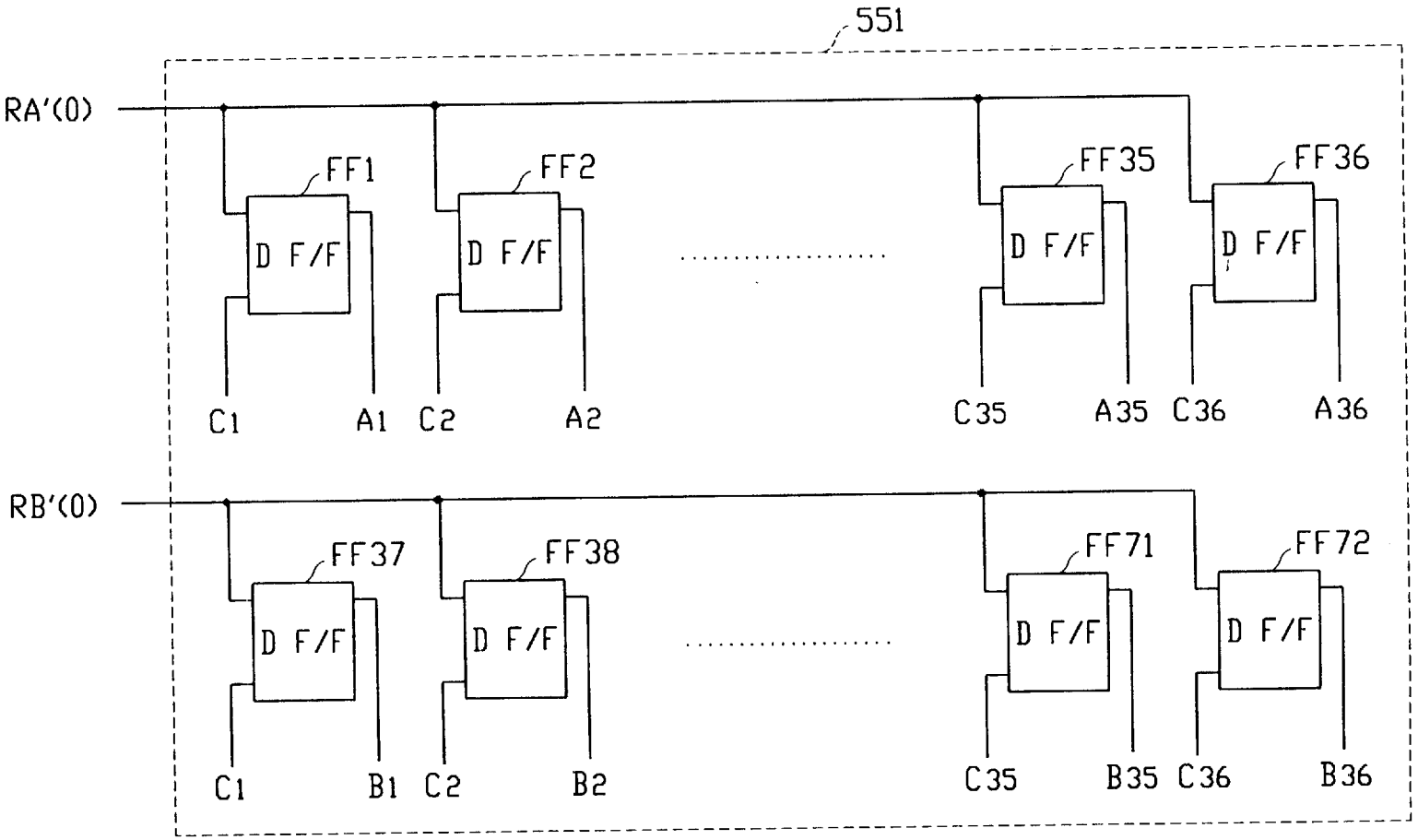
FIG. 27 shows a circuit diagram of the latch block in FIG. 24.

In FIG. 27, the latch block 551 comprises: L number of flipflops FF1–FF36 for latching the color signal RA'(0) from the data frequency divider 53 in response to control signals C1–C36; L number of flipflops FF37–FF72 for latching the color signal RB'(0) in response to the latch control signals C1–C36. The flipflops of the embodiment of the present invention are D-flipflops, but the scope of the present invention does not restrict to D-flipflops and other type of flipflops can be used. L number is 36 according to the assumption.

The color signal RA'(0) is commonly inputted to each data input terminal of the L number of flipflops FF1–FF36. A latch control signal among the L number of latch control signals C1–C36 is inputted to each clock input terminal of the flipflops.

The color signal RB'(0) is commonly inputted to each data input terminal of another L number of flipflops FF37–FF72 and a corresponding latch control signal among the L number of latch control signals C1–C36 is inputted to each clock input terminal of the flipflops.

Each flipflop sustains the signal of the data input terminal to an output terminal at a rising edge of the signal of clock input terminal.

In FIG. 27, flipflop FF1 latches data D1 of the color signal RA'(0) of the data input terminal to an output terminal A1 at the rising edge of latch control signal C1, and sustains the data D1 in the output terminal A1 until next rising edge of the latch control signal C1 appears.

As the latch control signal C1 is connected to flipflops FF1 and FF37 simultaneously, both of flipflops FF1 and FF37 latch first data D1 and D2 of color signals RA'(0) and RB'(0) by means of the rising edge of the latch control signal C1.

In a similar manner, other flipflops latch signals of the data input terminal by means of corresponding latch control signals.

Output terminal data of the flipflops FF1–FF72 is transmitted to an odd data adding block 552 and an even data adding block 553. The latch control signals C1–C36 enable the above operation in the data lines of color signals RA'(0)

and RB'(0) to be repeated by every n number of channels. For example, when the channel number of data driver IC is 300, the latching operation is repeated by latch signals C1–C36 for every 300 data of color signals RA'(0) and RB'(0).

Figure 32:
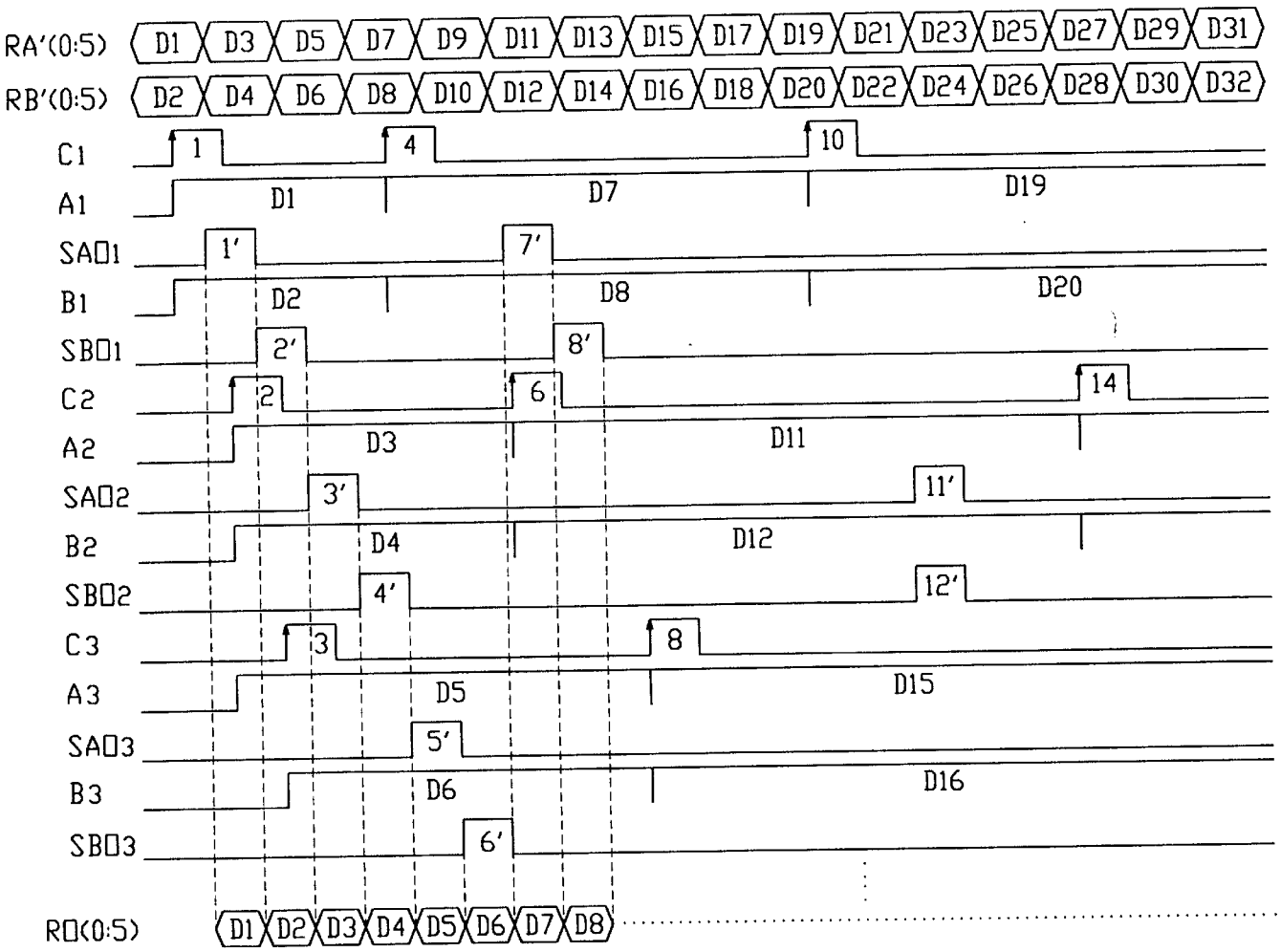
FIG. 32 shows waveforms to illustrate control steps which are performed in the data processing cell of FIG. 24.

As shown in FIG. 32, each of the latch control signals has more than two rising edges during n pulses of the half frequency clock signal. Thus, much less number of latch control signals than the channel number are used, and complexity of flipflops and circuits can be avoided.

Figure 28:
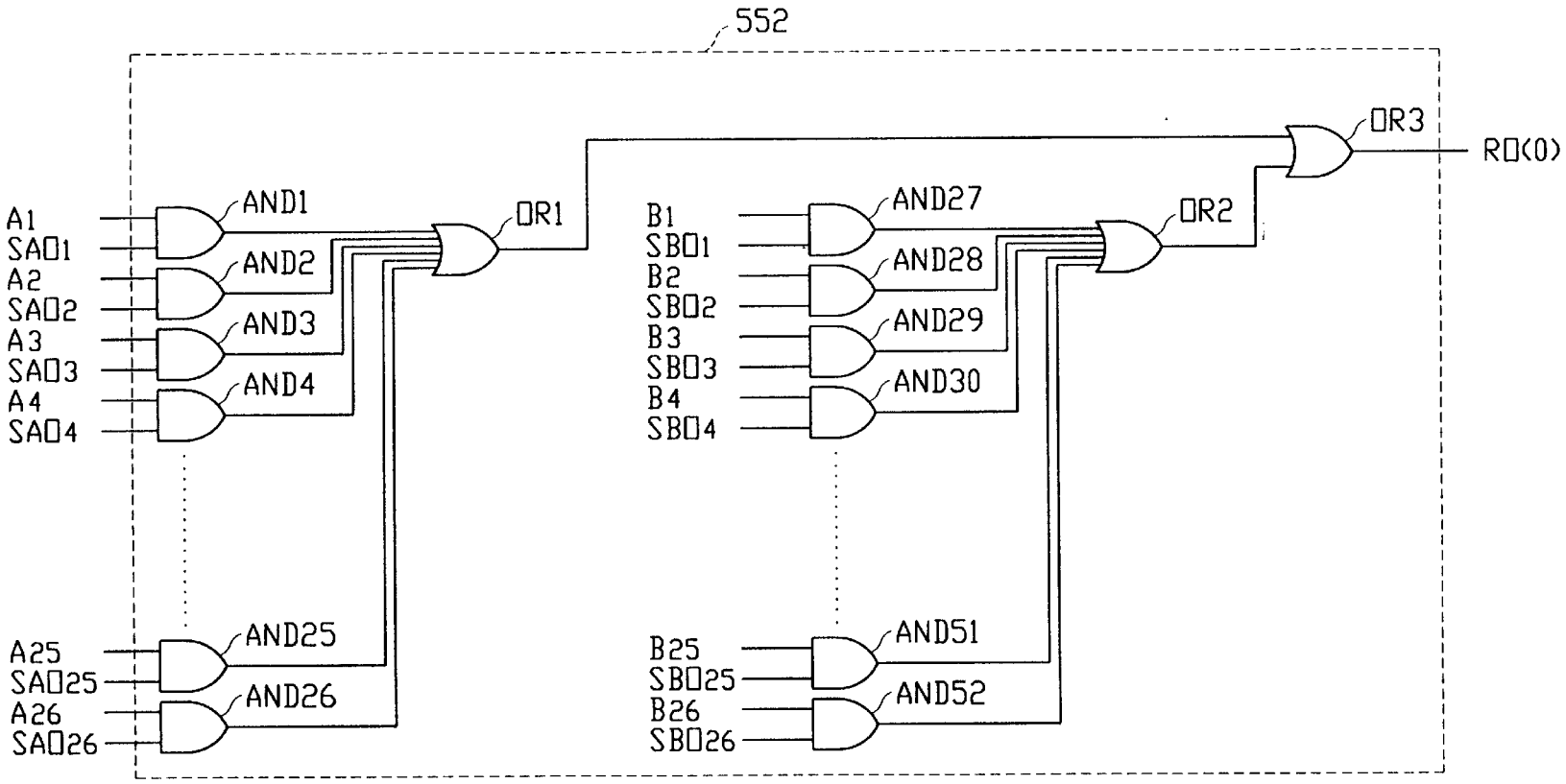
FIG. 28 and FIG. 29 show circuit diagrams of the first and the second composite blocks in FIG. 24.

FIG. 28 shows the first composite block 552.

The first composite block 552 includes:

M number of AND gates AND1–AND26 for receiving adding control signals SAO1–SAO26 and corresponding output signals of the latch block 551;

an OR gate OR1 for receiving output signals of the AND gates AND1–AND26;

M number of AND gates AND27–AND52 for receiving adding control signals SBO1–SBO26 and corresponding output signals of the latch block 551;

an OR gate OR2 for receiving output signals of the AND gates AND27–AND52; and an OR gate OR3 for generating an odd data signal RO(0) after receiving the output signals from OR gates OR1 and OR2.

Each of the AND gates performs a logical AND function for input signals. The OR gate OR1 performs a logical OR function for output signals of the AND gates AND1–ADN26. The OR gate OR2 performs a logical OR function for output signals of the AND gates AND27–AND 2. The OR gate OR3 preforms output signals of the OR gates OR1 and OR2.

Through the logical circuit described above, an odd data signal RO(0) is provided as a corresponding output signal of the latch block 551 in a high level duration of an adding control signal. For example, an adding control signal SAO1 and an output terminal signal A1 of flipflop FF1 are inputted to the AND gate AND1. As shown in FIG. 32, when the adding control signal SAO1 becomes a high level data, an odd data signal RO(0) is provided as an output terminal signal A1 of flipflop FF1.

In FIG. 32, timing of high level of the adding control signals SAO1 to SAO26 and SBO1 to SBO26 is predetermined so that the data of color signals RA'(0) and RB'(0) may appear alternately in every other number corresponding to the channel number of data driver IC. For example, when the channel number of data driver IC is 100, FIG. 30 illustrates an odd component RO(0) and an even component RE(0) generated in the first composite block 552 and the second composite block 553 shown in FIGS. 23 and 24. As shown in FIG. 30, a unit of hundred color signal data appears alternately in the odd component RO.

More specifically, the initial 100 data of the color signal appear in the odd component RO, and the next 100 data appear in the even component RE. By repeating the above operation, an improved single bank color signal according to the present invention is generated.

Figure 29:
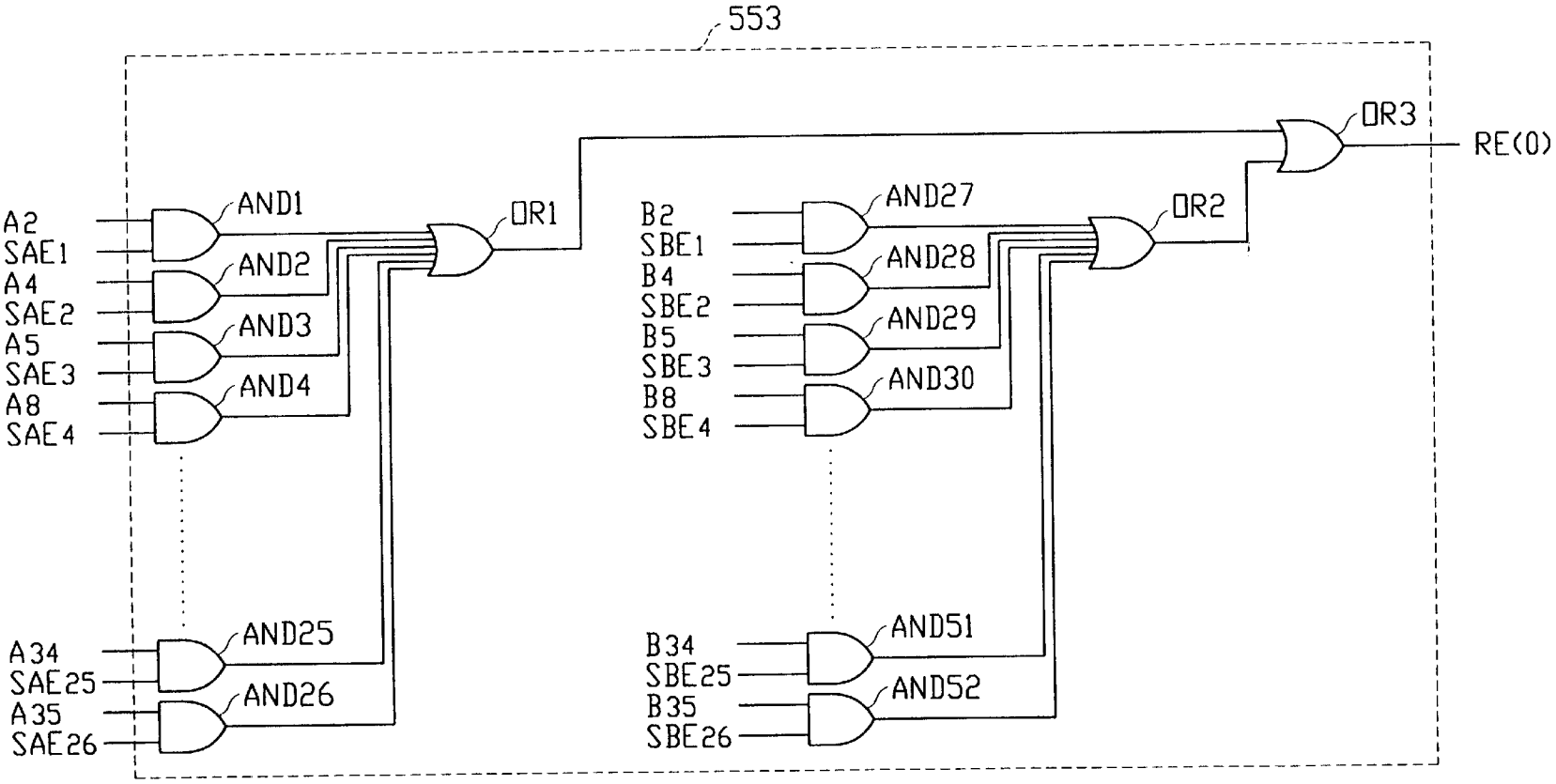

FIG. 29 shows a circuit of the second composite block 553 in further detail, which is identical to a circuit of the first composite block 552. The difference between the two circuit diagrams is an input signal of each of the AND gates only.

Shown in FIG. 29, the first composite block 552 includes:

M number of AND gates AND1–AND26 for receiving adding control signals SAE1–SAE26 and corresponding output signals of the latch block 551;

an OR gate OR1 for receiving output signals of the AND gates AND1–AND26;

M number of AND gates AND27–AND52 for receiving adding control signals SBE1–SBE26 and corresponding output signals of the latch block 551;

an OR gate OR2 for receiving output signals of the AND gates AND27–AND52; and an OR gate OR3 for generating an even data signal RE(0) after receiving the output signals from OR gates OR1 and OR2.

The odd component and the even component generated above are inputted to an odd data driver IC and an even data driver IC respectively. Accordingly, odd data driver ICs are operated by the odd component, and simultaneously even data driver ICs are operated by the even component. Consequencly, the odd data driver ICs and the even data driver ICs can be operated in a dual mode.

If a duration is same as in the single bank method, the time to drive a data line increases two fold by means of dual mode operation of the data line, so that an operation frequency can be reduced by half.

The timing control device according to the fourth embodiment can generate the improved single bank color signal according to the present invention even when a single bank color signal or a dual bank color signal is inputted. It also can reduce the number of flipflops and gate devices by reducing signal lines of the control signal.

What is claimed is:

1. A timing control device for liquid crystal display, comprising:

a control signal processor for generating a control signal for a gate driver and a data driver of liquid crystal display after receiving a vertical synchronizing signal, horizontal synchronizing signal and a main clock signal;

a sequential signal generator for generating a latch clock signal and a sequential control signal after receiving the main clock signal and a data enable signal;

a plurality of shift blocks for shifting sequentially an odd data and an even data of a dual bank color signal in response to the main clock signal and for outputting them;

a plurality of latch blocks for outputting simultaneously n number of odd data and n number of even data outputted from the shift blocks in response to the latch control signal;

a plurality of first composite blocks for generating an odd component of color signal by logical AND functions of n/2 number of odd data and n/2 number of even data outputted from the latch blocks with the sequential control signals in an alternative mode and then by logical OR functions of the result of the logical AND functions; and a plurality of second composite blocks for generating an odd component of color signal by logical AND functions of the remaining n/2 number of odd data and the remaining n/2 number of even data outputted from the latch blocks with the sequential control signals in an alternative mode and then by logical OR functions of the result of the logical AND functions.

2. A timing control device for liquid crystal display of claim 1, wherein one of the plurality of shift blocks comprises:

a first n-flipflops, which are serially connected with each other, for shifting the odd data sequentially; and a second n-flipflops, which are serially connected with each other, for shifting the even data sequentially, each of the n-flipflops performing a shift operation in accordance with the main clock signal.

3. A timing control device for liquid crystal display of claim 2, wherein one of the plurality of latch blocks comprises a third n-flipflops for receiving outputs from the first n-flipflops and a fourth n-flipflops for receiving outputs from the second n-flipflops, the third n-flipflops and the fourth n-flipflops latching inputs simultaneously to output terminals in accordance with the latch clock signal.

4. A timing control device for liquid crystal display of claim 3, wherein one of the plurality of first composite blocks comprises: n number of AND gates having two input terminals for performing logical AND functions of both input signals from the input terminals; and an OR gate for performing a logical OR function after receiving outputs from the AND gates, n/2 number of outputs from the third n-flipflops and n/2 number of outputs from the fourth n-flipflops being inputted alternately to an input terminal of n number of AND gates and the sequential control signals being inputted sequentially to the other input terminals of n number of AND gates.

5. A timing control device for liquid crystal display of claim 3, wherein one of the plurality of second composite blocks comprises: n number of AND gates having two input terminals for performing logical AND functions of both input signals; and an OR gate for performing a logical OR function after receiving outputs from the AND gates, remaining n/2 number of outputs from the third n-flipflops and remaining n/2 number of outputs from the fourth n-flipflops being inputted alternately to an input terminal of n number of AND gates and the sequential control signals being inputted alternately to another input terminal of n number of AND gates.

6. A liquid crystal display, comprising:

a control signal processor for generating a control signal to control a gate driver and a data driver of liquid crystal display after receiving a vertical synchronizing signal, a horizontal synchronizing signal and a main clock signal;

a sequential signal generator for generating a latch clock signal and a sequential control signal after receiving a main clock signal and a data enable signal;

a plurality of shift blocks for shifting sequentially an odd data and an even data of a dual bank color signal in accordance with the main clock signal and for outputting them;

a plurality of latch blocks for outputting simultaneously n number of odd data and n number of even data which are outputted from the shift blocks in accordance with the latch clock signal;

a plurality of first composite blocks for generating an odd component of color signal by logical AND functions of n/2 number of odd data and n/2 number of even data outputted from the latch blocks with the sequential control signals in an alternative mode and then by logical OR functions of the result of the logical AND functions;

a plurality of second composite blocks for generating an odd component of color signal by logical AND functions of the remaining n/2 number of odd data and the remaining n/2 number of even data outputted from the latch blocks with the sequential control signals in an alternative mode and then by logical OR functions of the result of the logical AND functions;

a plurality of odd data driver ICs, each having n number of channels, for generating a liquid crystal drive signal after receiving the odd component of color signal outputted from the plurality of first composite blocks;

a plurality of even data driver ICs, each having n number of channels, for generating a liquid crystal drive signal after receiving the even component of color signal outputted from the plurality of second composite blocks; and a liquid crystal display panel which operates in response to a liquid crystal display drive signal inputted from the plurality of data driver ICs, said plurality of odd data driver ICs and said plurality of even data driver ICs being arranged serially on one part of the liquid crystal display panel.

7. A timing control device for liquid crystal display, comprising:

a control signal processor for generating a latch clock signal, a half frequency clock signal obtained by dividing a main clock signal and a control signal for a gate driver and a data driver for liquid crystal display after receiving a vertical synchronizing signal, a horizontal synchronizing signal and a main colck signal;

a sequential signal generator for generating a sequential control signal from a data enable signal and the half frequency clock signal;

a plurality of shift blocks for shifting color signal data sequentially according to the main clock signal after receiving a single bank color signal and for outputting them;

a plurality of latch blocks for dividing every n unmber of color data outputted from the shift blocks and for outputting 2n number of color data in response to the latch clock signal;

a first composite block for generating an odd component of a color signal by logical AND functions of n data from the latch block with the sequential control signals in a serial mode and then by logical OR functions of the result of the logical AND functions; and a second composite block for generating an even component of a color signal by logical AND functions of the remaining n data from the latch block with the sequential control signals in a serial mode and then by logical OR functions of the result of the logical AND functions.

8. A timing control device for liquid crystal display of claim 7, wherein one of the plurality of shift blocks comprises 2n number of serially connected flipflops, each of the flipflops performing said data shift operation in response to the main clock signal.

9. A timing control device for liquid crystal display of claim 8, wherein one of the plurality of latch blocks comprises:

a first n-flipflop for receiving n number of outputs from 2n number of flipflops; and a second n-flipflop for receiving remaining n number of outputs from 2n number of flipflops, said first n-flipflop and second n-flipflop latching said inputs simultaneously to output terminals in response to the latch clock signals.

10. A timing control device for liquid crystal display of claim 9, wherein one of the plurality of first composite blocks comprises:

n number of AND gates having two input terminals for performing a logical AND function of both input signals; and an OR gate for performing a logical OR function after receiving outputs from the AND gates, outputs from the first n-flipflops being inputted sequentially to an input terminal of n number of AND gates and the sequential control signals being inputted sequentially to the other input terminals of n number of AND gates.

11. A timing control device for liquid crystal display of claim 9, wherein one of the plurality of second composite blocks comprises:

n number of AND gates having two input terminals for performing a logical AND function of both input signals; and an OR gate for performing a logical OR function after receiving outputs from the AND gates, outputs from the first n-flipflops being inputted sequentially to an input terminal of n number of AND gates and the sequential control signals being inputted sequentially to the other input terminals of n number of AND gates.

12. A liquid crystal display, comprising:

a control signal processor for generating a latch clock signal, a half frequency signal obtained by dividing a main clock signal and a control signal for a gate driver and a data driver for liquid crystal display after receiving a vertical synchronizing signal, a horizontal synchronizing signal and a main colck signal;

a sequential signal generator for generating a sequential control signal from a data enable signal and the half frequency clock signal;

a plurality of shift blocks for shifting color signal data sequentially according to the main clock signal after receiving a single bank color signal and for outputting them;

a plurality of latch blocks for dividing every n unmber of color data outputted from the shift blocks and for outputting 2n number of color data in response to the latch clock signal;

a first composite block for generating an odd component of a color signal by logical AND functions of n number of data from the latch block with the sequential control signals sequentially and then by logical OR functions of the result of the logical AND functions;

a second composite block for generating an even component of a color signal by logical AND functions of the remaining n number of data from the latch block with the sequential control signals sequentially and then by logical OR functions of the result of the logical AND functions;

a plurality of odd data driver ICs, each having n number of channels, for generating a liquid crystal display drive signal after receiving an odd component of a color signal from the first composite blocks;

a plurality of even data driver ICs, each having n number of channels, for generating a liquid crystal display drive signal after receiving an even component of a color signal from the plurality of second composite blocks; and a liquid crystal display panel which operates in response to a liquid crystal display drive signal inputted from the plurality of data driver ICs, said plurality of odd data driver ICs and said plurality of even data driver ICs being arranged serially on one part of the liquid crystal display panel.

13. A timing control device for liquid crystal display, comprising:

a control signal processor for generating a latch clock signal, a half frequency clock signal obtained by dividing a main clock signal and a control signal for a gate driver and a data driver for liquid crystal display after receiving a vertical synchronizing signal, a horizontal synchronizing signal and a main colck signal;

a sequential signal generator for generating n number of latch control signals within every n clock pulses of the main clock signal and n number of sequential control signals within every n clock pulses of the half frequency clock signal after receiving a main clock signal, a half frequency clock signal and a data enable signal, each of n number of latch control signals having a high level duration equal to one pulse duration of the main clock signal and each of n number of sequential control signals having a high level duration equal to one clock pulse duration of the half frequency clock signal;

a plurality of latch blocks, after receiving a single bank color signal and the latch control signal, for outputting sequentially data of the single bank color signal in the high level duration of the latch control signal, and for sustaining the output state until a next high duration of the latch control signal is inputted;

a plurality of first composite blocks for generating an odd component of a color signal during the sustaining period by logical AND functions of color signal data from the latch block with the sequential control signals in a serial mode and then by logical OR functions of the result of the logical AND functions; and a plurality of second composite blocks for generating an even component of a color signal during the sustaining period by logical AND functions of color signal data from the latch block with the sequential control signals of rearranged sequence and then by logical OR functions of the result of the logical AND functions.

14. A timing control device for liquid crystal display of claim 13, wherein one of the plurality of latch blocks include n number of flipflops for receiving the single bank color signal in common, each of n number of flipflops latching data of the single bank color signal according to a corresponding signal among n number of latch control signals.

15. A timing control device for liquid crystal display of claim 14, wherein one of the plurality of first composite blocks comprises:

n number of AND gates having two input terminals for performing a logical AND function of both input signals; and an OR gate for performing a logical OR function after receiving outputs from the AND gates, outputs from n number of flipflops being inputted sequentially to an input terminal of n number of AND gates and the sequential control signals being inputted sequentially to the other input terminals of n number of AND gates.

16. A timing control device for liquid crystal display of claim 14, wherein one of the plurality of second composite blocks comprises:

n number of AND gates having two input terminals for performing a logical AND function of both input signals; and an OR gate for performing a logical OR function after receiving outputs from the AND gates, outputs from n number of flipflops being inputted sequentially to an input terminal of said n number of AND gates and the sequential control signals being inputted to the other input terminal of said n number of AND gates in a sequence that starts from the second half of n number.

17. A liquid crystal display, comprising:

a control signal processor for generating a latch clock signal, a half frequency clock signal obtained by dividing a main clock signal and a control signal for a gate driver and a data driver for liquid crystal display after receiving a vertical synchronizing signal, a horizontal synchronizing signal and a main colck signal;

a sequential signal generator for generating n number of latch control signals within every n clock pulses of the main clock signal and n number of sequential control signals within every n clock pulses of the half frequency clock signal after receiving a main clock signal, a half frequency clock signal and a data enable signal, each of n number of latch control signals having a high level duration equal to one pulse duration of the main clock signal and each of n number of sequential control signals having a high level duration equal to one clock pulse duration of the half frequency clock signal;

a plurality of latch blocks, after receiving a single bank color signal and the latch control signal, for outputting sequentially data of the single bank color signal in the high level duration of the latch control signal, and for sustaining the output state until a next high duration of the latch control signal is inputted;

a plurality of first composite blocks for generating an odd component of a color signal during the sustaining period by logical AND functions of color signal data from the latch block with the sequential control signals in a serial mode and then by logical OR functions of the result of the logical AND functions;

a plurality of second composite blocks for generating an even component of a color signal during the sustaining period by logical AND functions of color signal data from the latch block with the sequential control signals of rearranged sequence and then by logical OR functions of the result of the logical AND functions;

a plurality of odd data driver ICs, each having n number of channels, for generating a liquid crystal display drive signal after receiving an odd component of a color signal from the first composite blocks;

a plurality of even data driver ICs, each having n number of channels, for generating a liquid crystal display drive signal after receiving an even component of a color signal from the plurality of second composite blocks; and a liquid crystal display panel which operates in response to a liquid crystal display drive signal inputted from the plurality of data driver ICs, said plurality of odd data driver ICs and said plurality of even data driver ICs being arranged serially on one part of the liquid crystal display panel.

18. A timing control device for liquid crystal display, comprising:

a control signal processor for generating a latch clock signal, a half frequency clock signal obtained by dividing a main clock signal and a control signal for a gate driver and a data driver for liquid crystal display after receiving a vertical synchronizing signal, a horizontal synchronizing signal and a main colck signal;

a data frequency divider for converting the single bank color signal to a dual bank color signal according to the half frequence clock signal when an input color signal from external selection signal is single bank, and for outputting the color signal without converting when an input color signal from external selection signal is dual bank;

a plurality of latch pulse generator, after receiving a data enable signal and a half frequency clock signal, for generating a first sequential control signal and a second sequential control signal from the data enable signal and the half frequency clock signal, for generating a latch control signal by performing a logical OR function of more than two of the first sequential control signal, and for generating an adding control signal by performing a logical OR function of more than two of the second sequential control signal; and a plurality of data processing cells for latching an odd data and an even data outputted from the data frequency divider according to the latch control signal, and for generating an odd component and an even component of color signal by performing a logical operation between the latched data and the adding control signal, said latch control signal and adding control signal being predetermined so that a data of color signal appears alternately in the odd component and the even component as much as the channel number of data driver IC, said odd component being inputted to odd numbered data driver IC of a data driver and said even component being inputted to even numbered data driver IC of a data driver.

19. A timing control device for liquid crystal display of claim 18, wherein one of the plurality of data processing cells comprises:

a latch block for latching a data of the color signal according to the latch control signal after receiving a color signal from the data frequency divider;

a first composite block for generating an odd component of color signal by performing a logical AND function of outputs from the latch block according to the adding control signal and then performing a logical OR function of the result of the logical AND function; and a second composite block for generating an even component of color signal by performing a logical AND function of outputs from the latch block according to the adding control signal and then performing a logical OR function of the result of the logical AND function.

20. A timing control device for liquid crystal display of claim 19, wherein the latch block comprises:

a first latch block having a plurality of flipflops for latching a data of a corresponding data input terminal according to the latch control signal, after receiving one of the latch control signal onto clock input terminal and odd numbered data of a dual bank color signal outputted from the data frequency divider commonly onto data input terminals; and a second latch block having a plurality of flipflops for latching a data of a corresponding data input terminal according to the latch control signal, after receiving one of the latch control signal onto clock input terminal and even numbered data of a dual bank color signal outputted from the data frequency divider commonly onto data input terminals.

21. A timing control device for liquid crystal display of claim 20, wherein said flipflops are D-flipflops, at a rising edge of the latch control signal, for latching data of data input terminals to output terminals.

22. A timing control device for liquid crystal display of claim 20, wherein the first composite block comprises:

a plurality of AND gates for performing logical AND functions of a output terminal signal and an adding control signal after receiving either the adding control signal or the output terminal signal of one of the flipflops of the first latch block;

a plurality of AND gates for performing logical AND functions of a output terminal signal and an adding control signal after receiving either the adding control signal or the output terminal signal of one of the flipflops of the second latch block; and a plurality of OR gates for performing logical OR functions of the output signals from the two group of AND gates above and then for performing another logical OR function of the result of the logical OR function.

23. A timing control device for liquid crystal display of claim 20, wherein the second composite block comprises:

a plurality of AND gates for performing a logical AND function of the adding control signal and the output terminal signal after receiving either the adding control signal or the output terminal signal of one of the flipflops of the first latch block;

a plurality of AND gates for performing a logical AND function of the adding control signal and the output terminal signal after receiving either the adding control signal or the output terminal signal of one of the flipflops of the second latch block; and a plurality of OR gates for performing logical OR functions of the output signals from the two group of AND gates above and then for performing another logical OR function of the result of the logical OR function.

24. A liquid crystal display, comprising:

a control signal processor for generating a latch clock signal, a half frequency clock signal obtained by dividing a main clock signal and a control signal for a gate driver and a data driver for liquid crystal display after receiving a vertical synchronizing signal, a horizontal synchronizing signal and a main colck signal;

a data frequency divider for converting the single bank color signal to a dual bank color signal according to the half frequency clock signal when a color signal from an external selecting signal is a single bank, and for outputting the color signal without a converting step when a color signal from an external selecting signal is a dual bank;

a plurality of latch pulse generators for generating a first sequential control signal and a second sequential control signal from the data enable signal and the half frequency clock signal after receiving the data enable signal and the half frequency clock signal, for generating a latch control signal by a logical OR function of more than two of the first sequential control signals, and for generating an adding control signal by a logical OR function of more than two of the second sequential control signals;

a plurality of data processing cells for generating an odd component and an even component of the color signal after latching an odd data and an even data of the dual bank color signal outputted from the data frequency divider and then carrying out a logical function between the latched data and the adding control signal;

a plurality of odd data driver ICs, each having n number of channels, for generating a liquid crystal display drive signal after receiving an odd component of a color signal from the first composite blocks;

a plurality of even data driver ICs, each having n number of channels, for generating a liquid crystal display drive signal after receiving an even component of a color signal from the plurality of second composite blocks; and a liquid crystal display panel which operates in response to a liquid crystal display drive signal inputted from the plurality of data driver ICs, said plurality of odd data driver ICs and said plurality of even data driver ICs being arranged serially on one part of the liquid crystal display panel.

* * * * *